United States Patent [19]

Wells

[11] 4,295,639

[45] Oct. 20, 1981

[54] COIL SPRING ASSEMBLY AND FORMING METHOD

[75] Inventor: Thomas J. Wells, Carthage, Mo.

[73] Assignee: Leggett & Platt, Incorporated, Carthage, Mo.

[21] Appl. No.: 81,818

[22] Filed: Oct. 4, 1979

[51] Int. Cl.[3] ..... F16F 3/04

[52] U.S. Cl. ..... 267/91; 5/269; 5/474; 140/3 CA; 140/92.4; 267/95; 267/96; 267/166

[58] Field of Search ..... 267/166–180, 267/97, 95, 96, 91, 93; 140/3CA, 92.4, 92.8, 92.3, 92.6, 92.94, 92.93; 5/269, 256, 260, 267, 278, 464, 474

[56] References Cited

U.S. PATENT DOCUMENTS

| | | | |
|---|---|---|---|
| 2,688,757 | 9/1954 | Bronstien | 5/278 |
| 2,945,245 | 7/1960 | Gleason | 267/91 X |
| 3,264,660 | 8/1966 | Goldmeyer et al. | 267/91 |
| 3,517,398 | 6/1970 | Patton | 267/91 |
| 4,095,297 | 6/1978 | Thomas, Jr. | 5/256 |
| 4,124,041 | 11/1978 | Higgins | 140/92.4 X |

*Primary Examiner*—Douglas C. Butler

*Attorney, Agent, or Firm*—Wood, Herron & Evans

[57] ABSTRACT

A coil spring assembly, and a method of forming that assembly, in which the assembly's edgemost coil springs are connected to a border wire by a single continuous spiral lacing wire. The method involves the steps of guiding a rotation spiral lacing wire completely around the periphery of a spring coil matrix and border wire through use of helical path defining dies until the leading and trailing ends of the lacing wire are overlapped. During the lacing operation, the helical path defining dies cooperate to deflect a peripheral segment of each corner and edge coil into juxtaposition with the border wire. The resulting final coil spring assembly includes corner coil springs in which the deflected peripheral segments of the corner coils are retained contiguous to the corner of the border wire by the lacing wire.

36 Claims, 26 Drawing Figures

SEE FIG. 1B
SEE FIG. 1A
24
58
57
55
56
20
16
14
13b
13a
13
15
11a
11b
12b
12a
12
10
11
28
27
25
26
29

TYPICAL PRIOR ART

COIL SPRING ASSEMBLY AND FORMING METHOD

This invention relates to spring assemblies. More particularly, this invention relates to an improved spring assembly of the type used in the bedding industry in which rows and columns of coil springs are joined to a border wire by a helical lacing wire and to a method of attaching that border wire to the coil spring matrix.

Spring assemblies are generally fabricated of a plurality of individual spring units, e.g. coil springs, organized into columns and rows of coils. These springs are held in spacial relation one to the other within the matrix by some type of fastener device or joint structure that interconnects adjacent springs throughout the matrix. Generally, a border wire is attached to the periphery of the matrix to reinforce the edge and to define its perimeter. After fabrication of the spring assembly, manufacture of a finished bedding product is completed by placing a cushion or pad of material, e.g. woven or non-woven batting, foam, or the like, over the top and/or bottom surfaces of a spring assembly and then enclosing the structure with an upholstered fabric to provide a salable product. The finished product may be either a mattress or a box spring.

It is common practice in the spring assembly art to connect adjacent individual coil springs within a spring matrix in both the top and bottom planes of the spring assembly. Whether the individual coils are connected together in both the top and bottom planes of the spring assembly depends upon the end use of the assembly, e.g. in a mattress the same border and row connector structures are used in both the top and bottom planes since both sides of a mattress are intended to be used alternatively as the top surface, but in a box spring a border and row connectors are used in only a single plane since only one surface, that in the top plane, is used as a supporting surface.

The most common type of spring assembly known to the prior art interconnects adjacent coils of the spring assembly by helical lacing wires which extend from one edge to the other edge of the assembly. The lacing wires connect adjacent springs within those rows by being wound around the top loops thereof. This prior art coil spring matrix is conventionally finished and converted into a completed spring assembly by attachment of a border wire in either or both the top and bottom planes of the spring unit. This border wire is generally a single heavy gauge wire preformed into a rectangular configuration and disposed in border fashion about the periphery of the spring matrix. It is usually attached to the peripheral portion of the end or face loops of the spring coils by helical lacing wires which wrap around the border wire and a border segment of the edgemost coil springs.

In the manufacture of bedding spring products, the primary production bottleneck and the greatest source of quality control problems has traditionally occurred in the attachment of the border wire to the coil spring matrix. It has long been the practice in the industry to generate the spring coils of the assembly automatically and to assembly those coils into a matrix automatically. At the point in the production cycle, the automation of the process stops and the border wire is manually attached to the matrix. This manual operation is a time consuming one which requires a high degree of skill and dexterity. It is also a process which takes a long time for an operator to learn so as to be reasonably proficient and to generate a product of sufficient quality to be acceptable.

As the border wire attachment process is now commercially practiced, a border wire preformed into a rectangular configuration, is placed within a frame and a coil spring matrix fitted on top of that border wire. A helical lacing wire is then introduced over the border wire at one corner of the assembly and is guided along that one side as the wire is rotated out of a helical forming machine. This machine is operative to form the wire into a helix of the appropriate diameter and pitch to fit over the border wire and the peripheral segments of the coil springs. In general, as the lacing wire is guided along the border wire two or three wraps of the lacing wire are guided around each end loop of the edgemost coils until the lacing wire reaches a corner of the spring unit. It is then guided around the corner and cut off. The border wire and spring matrix are then reoriented to position the corner at which the wire was cut off adjacent to the helical forming machine. The lacing wire is then restarted along the second side of the border wire and wrapped around that side until the lacing wire has passed around the next corner where it is again cut off. This practice is repeated until the border wire is connected to the spring matrix border wire on all four sides of the matrix.

As a variation of the process set forth hereinabove, it has long been known that it is possible to manually guide the helical lacing wire along two sides of the matrix and around one corner before cut off of the lacing wire. This practice though has generally been considered to be impractical because of the difficulty of getting the lacing wire around the corner of the matrix. That difficulty arises because of a difference in radius between the corner of the border wire and the adjacent section of the corner coil and because the lacing wire is sized so as to wrap the border wire and spring coils as tightly as possible. This tightness is necessary to avoid relative movement and consequent "noise" in the resulting product. Therefore, there is substantial drag or resistance to movement of the lacing wire along the length of the border wire and particularly to movement of the lacing wire around a corner of the matrix. In order to force the helical lacing wire around a corner, it is common practice for the operator to retard rotational movement of the lacing wire at its leading edge so that the rotating lacing wire opens up in diameter, thereby reducing the resistance of the wire to move over the border wire and laced coils but in the process reducing the quality of the resulting product because the now large diameter lacing wire securing the coil springs to the border wire permits greater movement between the coils and the border wire.

There are a number of quality control problems which result from the manual application of border wires to the spring matrix as described hereinabove. One of these problems occurs as a consequence of the loops of the helical lacing wire tending to grow larger from the leading to the trailing end of the wire due to the operator's retarding rotation of the leading end of the wire and increasing its diameter in order to reduce the friction or resistance to rotation as the helical wire proceeds along the length of the border wire. This increasing of the diameter of the helical wire facilitates application of the helical lacing wire to the border and speeds the application for the operator, but in the process it results in a product in which the coil springs are relatively free to move relative to the border wire and are therefore loose and noisy.

Another common quality control problem with manually applied border lacing wires occurs as a consequence of the number of lacing convolutions which connect coil springs to the border wire differing one from another, e.g. one border spring may be connected by three convolutions of the lacing wire and the next border spring may be connected by only two convolutions of the lacing wire. Whenever only two convolutions connect the coil spring to the border that spring too will be loose when compared with the next adjacent coil spring which has three wraps around it connecting it to the border wire. This looseness also tends to promote noise in the resulting product and permits the coil spring to move or snap from one side of the border wire to the other, sometimes being located above the border wire and other times below the border wire. The resulting product is not only noisy but is non-uniform in height or thickness.

Another quality control problem which results from the manual application of the border lacing wires occurs at the corners of the coil spring assembly where the face or end loop of the corner coil spring usually extends substantially beyond the arcuate corner segment of the border wire. Whenever a corner segment of a corner coil extends beyond the corner segment of the border wire, that corner spring's extending corner segment tends to push or work its way through the casing or cover of the resulting mattress or box spring, since it is not symmetrically conformed to the border wire corner. This, of course, is undesirable.

Probably the greatest problem through which occurs as a consequence of manual application of border lacing wires is the production bottleneck which it generates. It often takes as much as a year to train an operator to become sufficiently proficient at applying border lacing wires so as to be reasonably cost justified. Many operators never are able to reach that skill level and consequently whenever a skilled operator leaves the employ of a spring assembly manufacturer, it may be years before a replacement can be trained. Whenever a new plant goes into production, it is oftentimes several years before the plant become sufficiently efficient to be profitable because of this single bottleneck.

Accordingly, it has been an objective of this invention to provide a new method of automatically applying border lacing wires to a coil spring matrix unit.

Another objective of this invention has been to create a new spring assembly method and resulting product which is not subject to all of the quality control problems set forth hereinabove.

Still another objective of this invention has been to provide a new spring assembly which utilizes a single continuous length helical lacing wire and method of applying that wire to the periphery of the unit without the use of a human operator to guide that lacing wire onto the unit.

In preferred form, the method of this invention involves the steps of continuously rotating a single extended length of spiral lacing wire of uniform diameter about its axis, introducing that lacing wire into lacing combination with the border springs and border wire at one corner of a spring matrix, and guiding that rotating spiral lacing wire around the periphery of the matrix's border springs through use of helical path defining dies. The single lacing wire is guided around the spring matrix's periphery until leading and trailing ends of the spiral lacing wire are juxtaposed one with another. In preferred form, and during the lacing steps, the helical path defining dies cooperate to deflect and to restrain a border segment of each corner and edge coil spring's face or end loop out of its generally circular configuration into the flat or arcuate configuration of the adjacent segment of the border wire. The final or resulting coil spring assembly has coil springs in which the deflected border segments of the corner coils are retained in an arcuate configuration contiguous to the corner of the border wire by the lacing wire.

There are a series of advantages that flow from this novel method and product relative to the methods and products known to the marketplace and to the prior art. With this invention, more spiral wraps can be provided to interconnect the border wire with the corner springs' face loops, and since those corner springs' face loops are at least partially retained in a deflected position contiguous to the corner of the border wire after assembly, the corner springs' face loops are prevented from extending substantially beyond the border wire so that the corner springs' face loops will not tend to work through a cover or casing. Further, the uniform helical lacing wire diameter from the leading end to the trailing end thereof around the entire periphery of the coil spring matrix, along with a preferably equal number of wraps for each corner border spring, and a preferably equal number of wraps for each edge border spring with the border wire, promotes uniform tightness between the border wire and the border springs which, in turn, tends to reduce noise generated during use of the spring assembly product. Also, with the border wire always positioned on the same side of all the border springs' face loops during interconnection by the helical lacing wire, and thereafter in the end product, the height of the spring assembly unit may be relatively closely controlled within reasonable tolerance limits. A further advantage of significance is that the helical lacing wire itself may be of a generally smaller diameter than is now commonly used in the spring assembly industry because of the close guidance provided during the lacing steps. All these advantages tend to promote better quality control, and indeed better quality, for the final coil spring assembly product, while simultaneously permitting a production rate substantially higher than that generated by the prior art manual application method.

Other objectives and advantages of this invention will be more apparent from the following detailed description taken in conjunction with the drawings in which.

COIL SPRING ASSEMBLY

Figures 1, 1C:
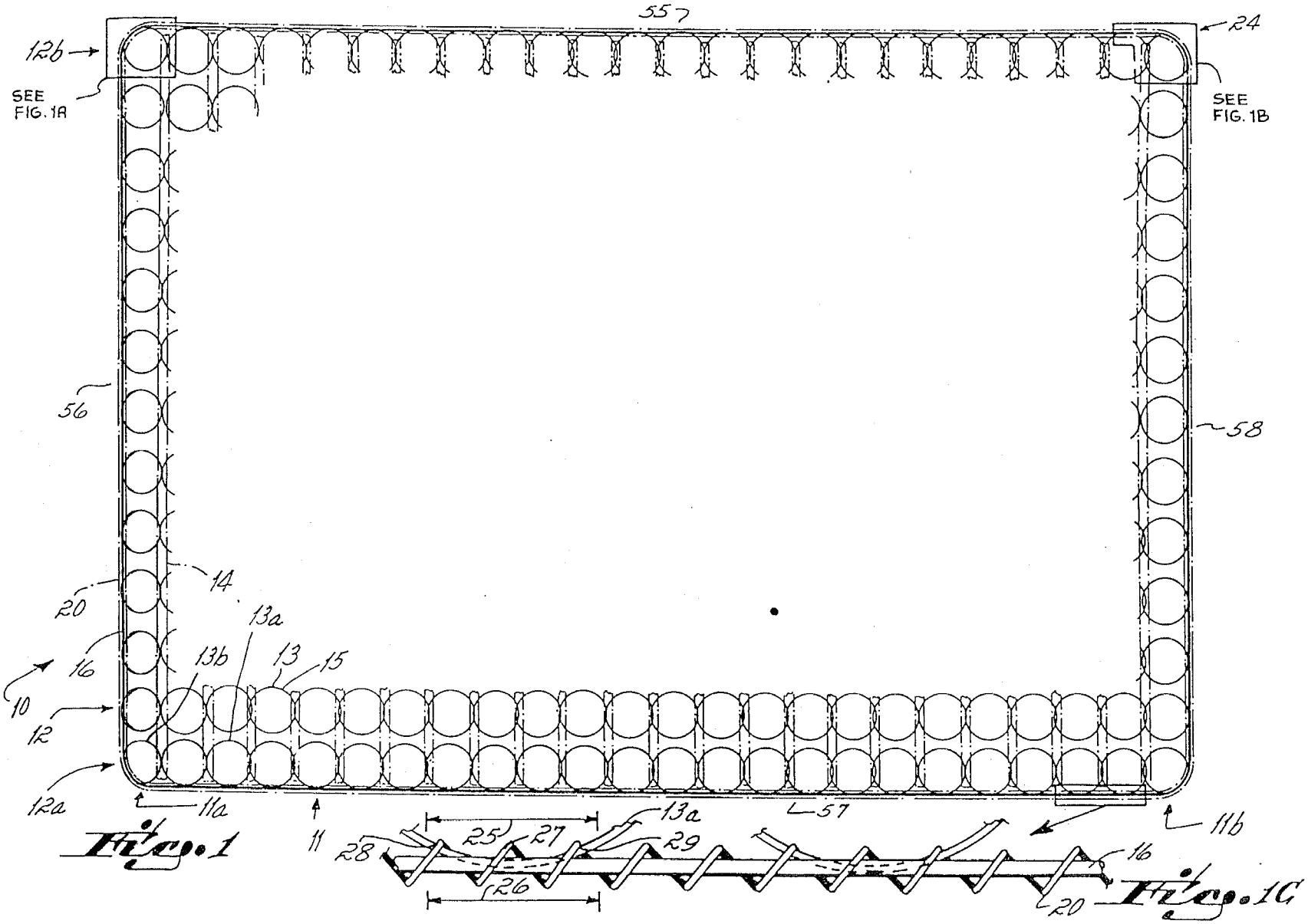
FIG. 1 is a top view of a coil spring assembly fabricated in accord with the principles of this invention.
FIG. 1C is an enlarged view of an edge section of the spring assembly shown in FIG. 1.

A coil spring assembly 10 in accord with the principles of this invention, and constructed in accord with the method of this invention, is illustrated in FIG. 1 in detail. The coil spring assembly 10 shown in that figure is in the form of a spring assembly of standard width having twenty-four transverse rows 11 and thirteen longitudinal columns 12. The rows 11 and columns 12 of coil springs 13 are, of course, arranged in rectangular matrix fashion, 11*a* and 11*b* denoting edge rows, 12*a* and 12*b* denoting edge columns. Each of the edge rows 11*a*, 11*b* and edge columns 12*a*, 12*b* of coil springs 13 is comprised of a series of edge border springs 13*a* and is terminated at each end by a corner spring 13*b*. The spring rows 12 are connected in fixed relation one with another by separate spiral lacing wires 14 which extend from adjacent one end of the row to adjacent the other end of the row in known fashion, thereby establishing the connected spring matrix. The coil springs 13 which comprise the spring matrix may be helical cone springs, or spiral cone springs of either a single cone or double cone type, but each of the coil springs presents a face loop 15 in each face of the mattress 10, i.e., in both upper and lower faces of the mattress, only the upper face loop 15 being shown. It is these face loops 15 of coil springs 13 in adjacent rows 12 that are interconnected one with the other by spiral row lacing wires 14, and it is these face loops 15 of edge 13*a* and corner 13*b* border springs which are connected with border wire 16 in accord with the principles of this invention.

A border wire 16 is connected to the spring matrix in both the upper face and lower face thereof, only one face being shown. The border wire 16 is of a closed loop or endless loop configuration and this closed loop is of a rectangular geometry analogous to the outer periphery of the coil spring matrix when that matrix is viewed from a line of sight normal to a face of the matrix. The border wire 16 preferably is of a heavier gauge than the spring wire from which the coil springs 13 are fabricated, see FIGS. 1A-1C.

The border wire 16 is fixed to the edge border springs 13*a* of the coil spring matrix, and to the corner border springs 13*b* of the coil spring matrix, by a single continuous length spiral lacing wire 20, which preferably is of a helical configuration. This spiral lacing wire 20 has a leading end 21 and a trailing end 22 which overlap or interlace one with another as shown at 23 adjacent one corner 24 of the spring assembly, see FIG. 1B. The lacing wire 20 is of a gauge less than the gauge of the coil spring 13 wire, and less than the gauge of the border wire 16. Further, the spiral lacing wire 20 is installed or connected with the border springs 13*a*, 13*b* and the border wire 16 so that the pitch P thereof remains substantially equal around the entire periphery of the assembly, and so that the diameter D thereof remains substantially constant around the entire periphery of the assembly.

The face loops 15 of the edge border springs 13*a* are connected to the border wire 16 as shown in detail in FIG. 1C. Each edge border springs' face loop 15 is connected at an arcuate border segment 25 with a linear segment 26 of the border wire. Note the border wire 16 overlies all of the edge border springs' face loops 15 on the same side thereof (the upper or outer side as shown in the figures). Note also that the helical lacing wire 20 connects the edge border springs' face loops 15 with the border wire 16 with an identical number of helical loops for each edge border spring 13*a* all around the periphery of the coil spring matrix. In the embodiment shown there are three helical loops 27 of the lacing wire 20 which cooperate to hold each edge border spring 13*a* in connected relation with the border wire 16. The sprial lacing wire 20 is preferably wrapped with a degree of tautness with the edge border springs' face loop segments 25 relative to border wire 16 so that pressure is induced on the inside periphery at two points 28 and 29 of the edge border springs' face loop segments 25 after the edge border spring are connected to the border wire by the helical lacing wire 20. This pressure is exerted, and is established, through use of the assembly method described in detail below. The pressure at points 28, 29 on the edge border springs' face loops 15 is desirable in that it tends to provide a tight mattress assembly which reduces noise upon use.

Figure 1B:
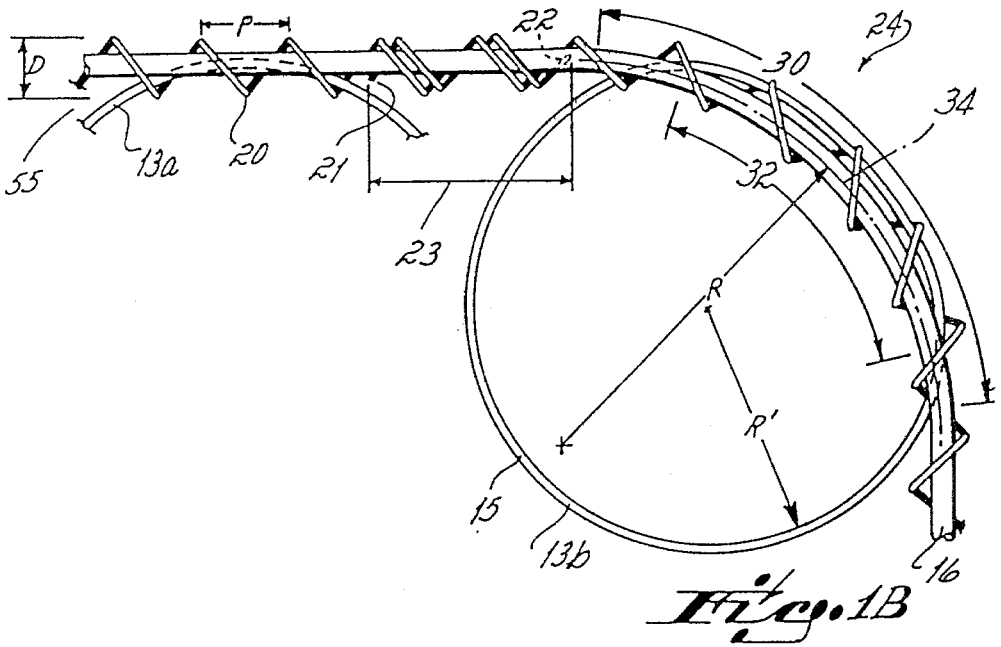
FIG. 1B is an enlarged view of another corner section of the spring assembly shown in FIG. 1, this corner being typical of the remaining three corners.
Figure 1A:
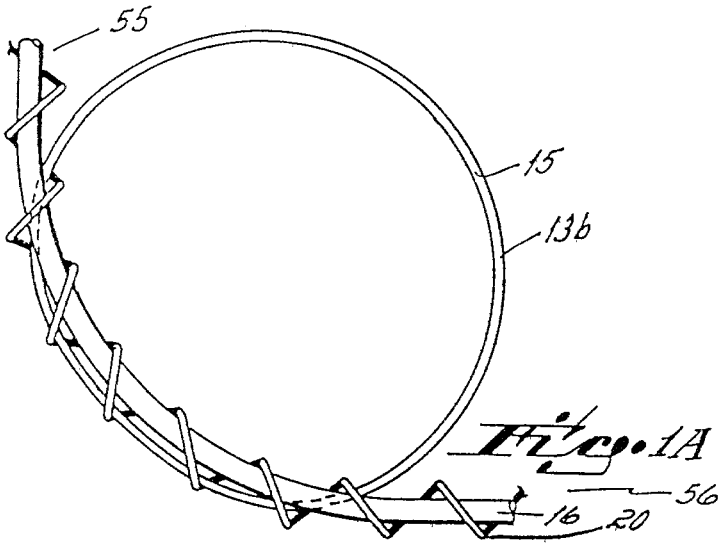
FIG. 1A is an enlarged view of one corner section of the spring assembly shown in FIG. 1.

The corner springs 13*b* of the coil spring matrix are attached to the arcuate corner segments 30 of the border wire 16 as shown in FIGS. 1A and 1B. FIG. 1A illustrates the structure at three of the mattress corners, and FIG. 1B illustrates the structure at that spring assembly corner 24 where the leading 21 and trailing 22 ends of the continuous length lacing wire 20 are interlaced. As shown in FIG. 1B, and as to all of the corners of the spring assembly, the radius of the arcuate corner segment 30 at the border wire 16 corners is R, and the normal or initial configuration radius of the corner border springs' face loops 15 is R'. But in the connected attitude as shown in FIG. 1B, that arcuate border segment 32 of each corner border spring's face loop 15 which is positively connected to the arcuate corner segment 30 of the border wire 16 is provided with a radius which is substantially equal to the radius R of the border wire's arcuate corner segment 30 and which, therefore, is substantially greater than the radius R' of the corner border spring's face loop in the initial configuration. This radius differential is established during construction of the coil spring assembly by deflection of each corner spring's face loop 15 from its initial attitude to one where its border segment 32 is of a radius substantially equal to the radius of the corner border segment 30 of the border wire 16. In the final assembled configuration, the border segment 32 of the corner border spring's face loop 15 is parallel to but outwardly spaced from the arcuate center line 34 of the corner border segment 30 of the border wire 16 due to the spring tension introduced into that face loop upon assembly and due to the tightness of the lacing wire 20 wraps at that corner. Thus, when a corner border spring 13*b* is connected with the border wire 16, tension is induced in the helical lacing wire 20 which prevents or restrains the corner border spring's top loop 15 from springing back to the initial circular configuration. Note at the corners that the helical lacing wire 20 makes use of six loops 27 to restrain the corner border spring 13*b* in the desired configuration, and that the corner border spring's face loop 15 does not extend substantially beyond the border wire's corner segment 30 when in the laced configuration. This structure presents a very tightly bound corner and provides certain advantages to the spring assembly discussed above.

One corner of the spring assembly is unique and is illustrated in FIG. 1B. This corner 24 is constructed the same as all the corners except that the single continuous length helical lacing wire 20 begins and ends at this corner. The difference at this corner 24 is that the leading end 21 of the helical lacing wire 20 is interlaced or overlapped with the trailing end 22 of the helical lacing wire for a short distance in an interlaced area 23 that extends for approximately two helical loops 27 as shown. It will thus be apparent that there are only two ends to the border lacing wire 20 used in this constructional arrangement, namely, a leading end 21 and a trailing end 22, so that the border lacing wire extends around the entire rectangular periphery of the spring assembly.

Figure 9:
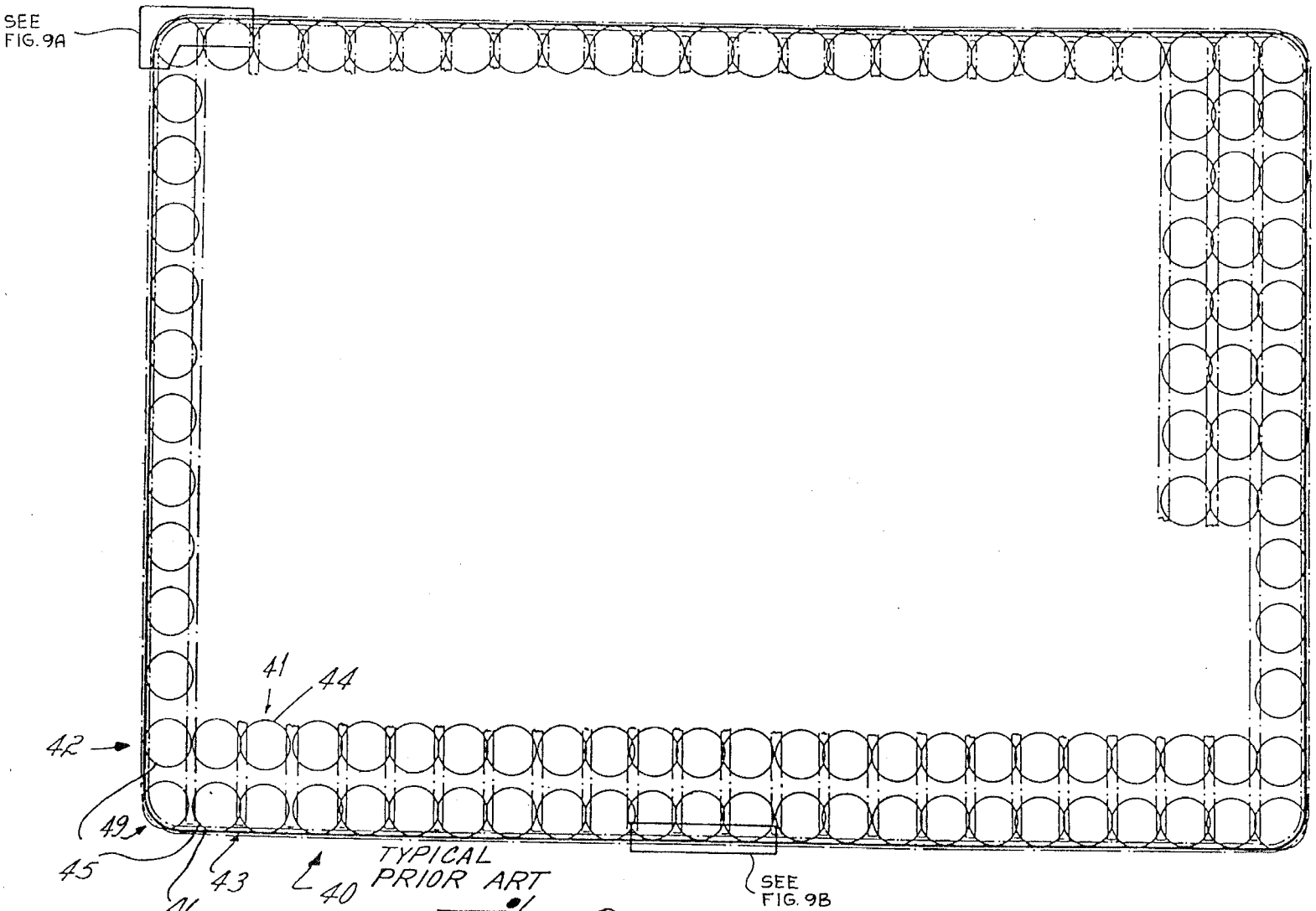
FIG. 9 is a view similar to FIG. 1, but showing a typical prior art coil spring assembly in a form generated by present commercial practice.
Figure 9A:
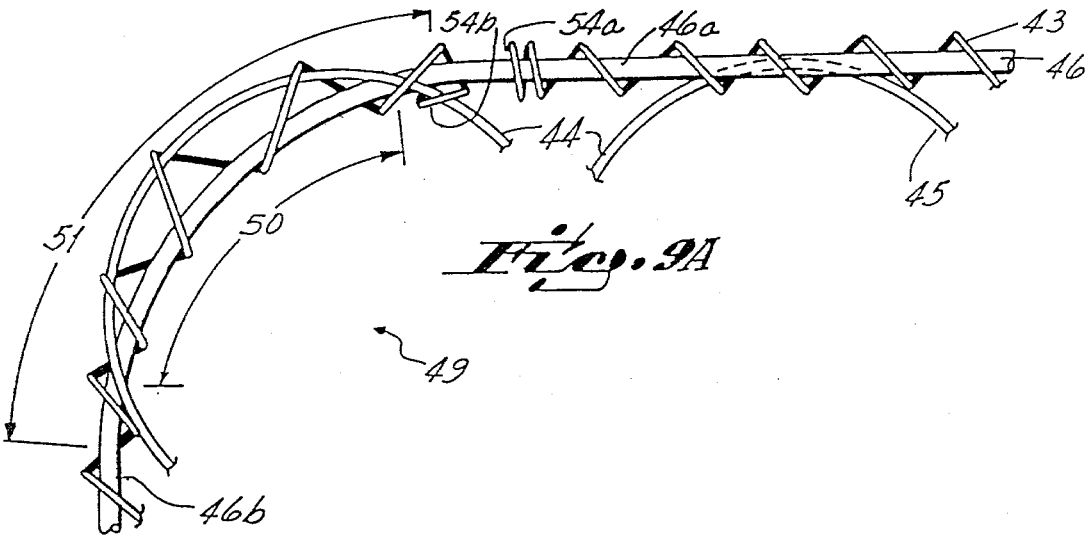
FIG. 9A is an enlarged view of one corner section of the coil spring assembly shown in FIG. 9.
Figure 9B:
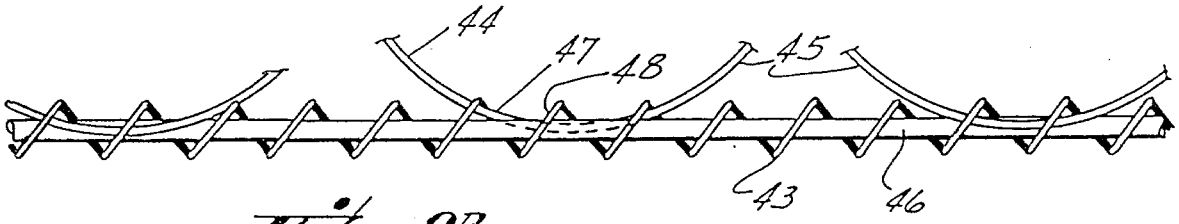
FIG. 9B is an enlarged top view of an edge section of the coil spring assembly shown in FIG. 9.

A typical prior art coil spring assembly 40 of the same basic coil row 41 and coil column 42 count and configuration is illustrated in FIG. 9. In a typical prior art commercial spring product 40, face loops 44 of the edge border springs 45 often slip relative to the loose lacing wire so that some of the face loop border segments 47 become located above and some below the border wire as shown in FIG. 9B. Further, one of two adjacent edge border springs' face loops 44 may be connected with an adjacent segment of the border wire through use of two helical lacing loops 48, whereas an immediately adjacent border spring face loop may be connected with an adjacent segment of the border wire by three helical lacing loops, also as shown in FIG. 9B. Loose lacing of the helical lacing wire 43 to the border wire 46 results from the manual technique utilized to apply all border lacing prior to this invention. That manual technique of guiding the rotating lacing wire over the border wire and the outermost spring coils promotes looseness and this uneven pattern of wraps around the border coils. As to corners 49 of the spring assembly, and as shown in FIG. 9A which is fairly typical of manually laced corners, note that the lacing wire 42 is open in diameter and embraces four rather than the ideal six wraps around the border segment 50 of the corner border spring's face loops 44 and the corner segment 51 of the border wire 46. In other words, the corner border spring is connected by four relatively loose wraps of the lacing wire around the border wire's corner segment 51 and the corner coil. This loose wrapping which is required to make the connection, provides the disadvantages discussed above relative to wear on the mattress' casing (not shown). Further, and in those instances where a single length of helical lacing wire 43 is used for each linear edge of the spring assembly 40, there will be two burred ends 54*a*, 54*b* for the lacing wires at each corner 49, one 54*a* for one side edge 46*a* of the border wire at that corner, and the other 54*b* for the other side edge 46*b* of the border wire at that corner, which multiplies the chances of defects arising by the burred ends passing through the mattress casing (not shown). The disadvantages of this prior art commercial construction practice relative to the advantages of applicant's invention are discussed in detail above.

COIL SPRING ASSEMBLY METHOD

Figure 2:
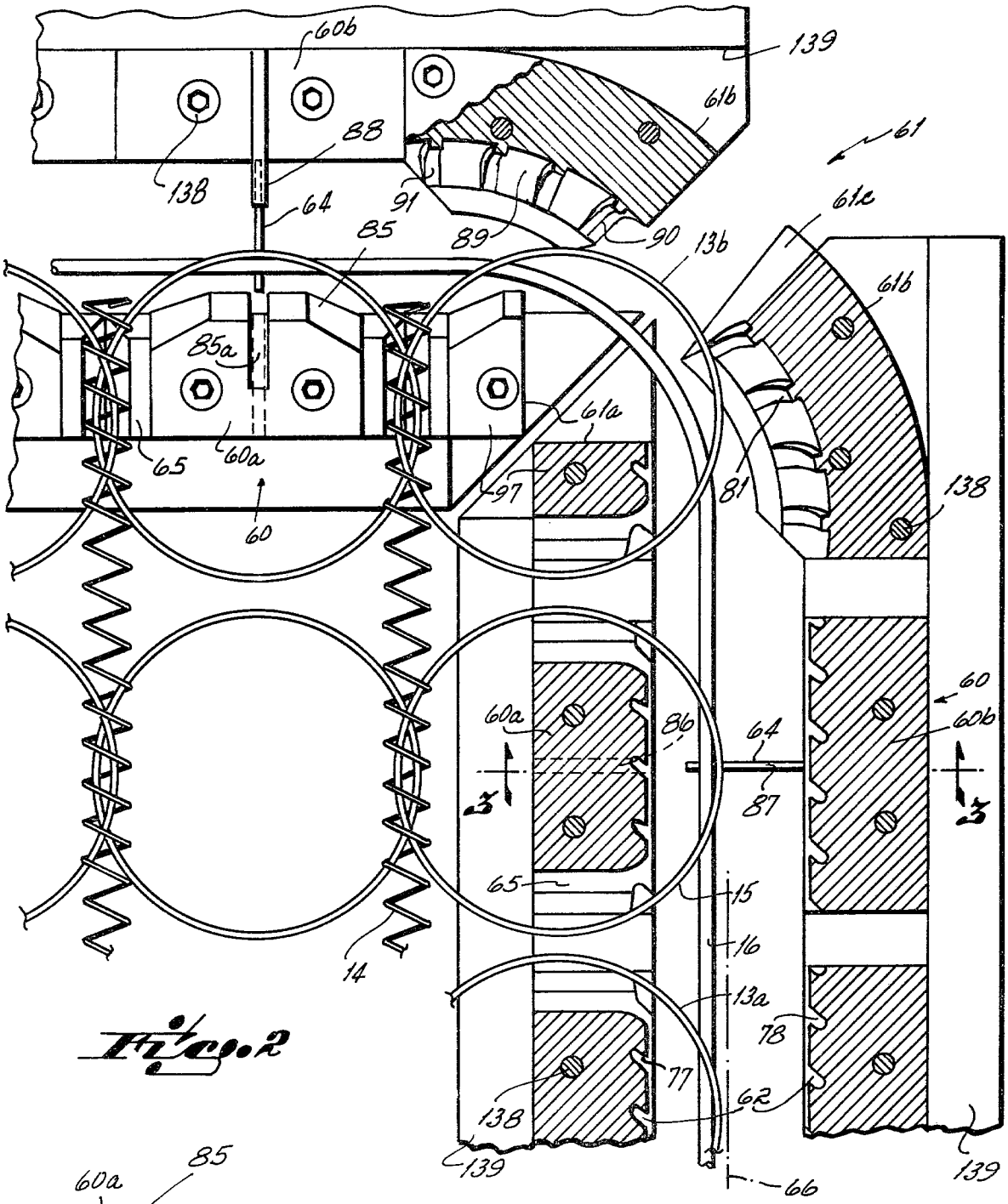
FIG. 2 is an enlarged top cross-sectional view showing a coil spring matrix and a border wire in an initial position, relative to a series of hold down dies, prior to lacing of the border wire with the edgemost coil springs.
Figure 5:
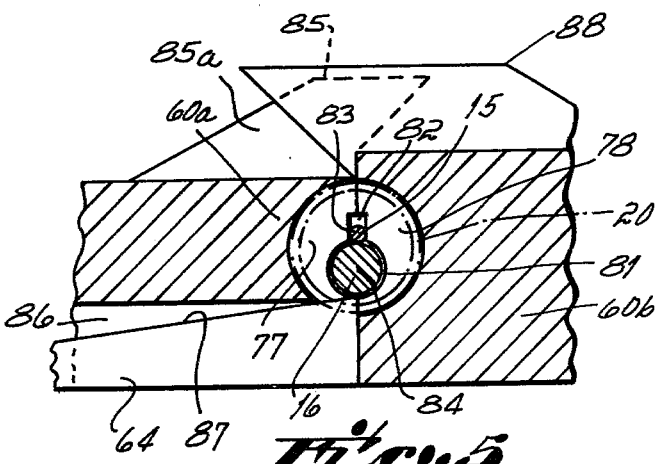
FIG. 5 is a cross-sectional view taken along line 5—5 of FIG. 4.
Figure 6:
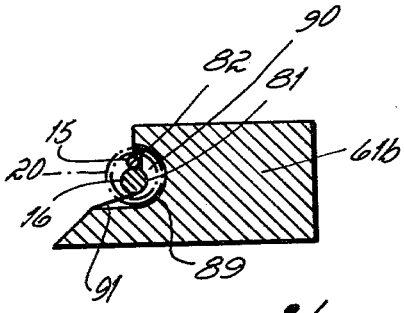
FIG. 6 is a cross-sectional view taken along line 6—6 of FIG. 4.
Figure 7:
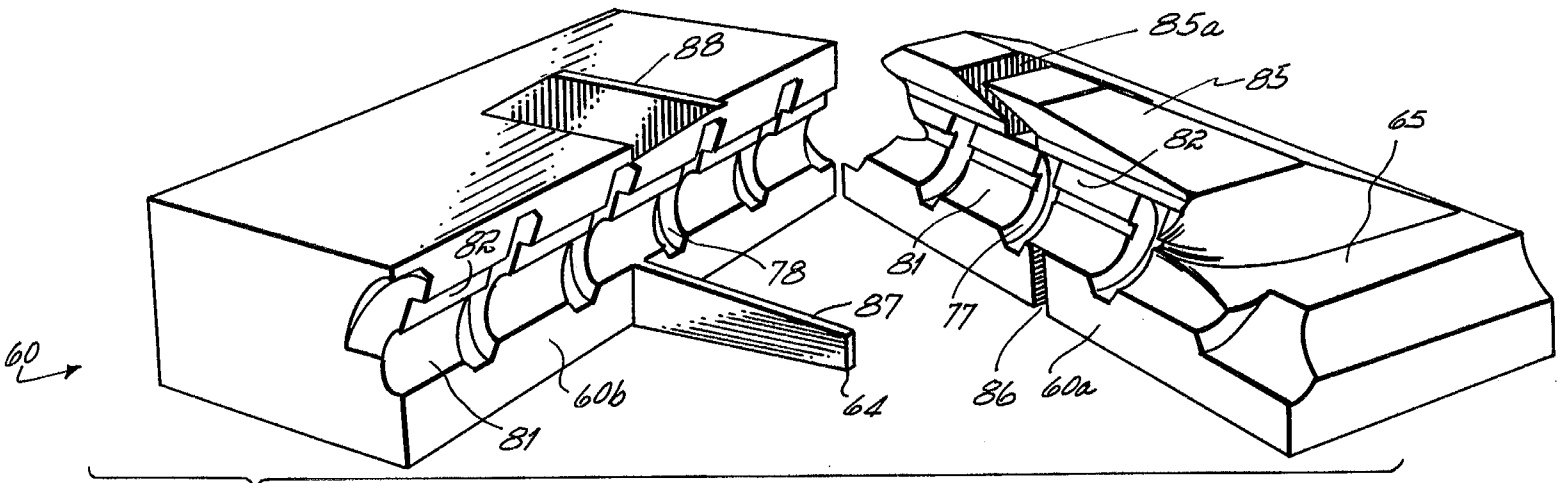
FIG. 7 is a perspective view of opposing hold down die halves adapted for use with a linear segment of the border wire and adjacent edge border spring.
Figure 8:
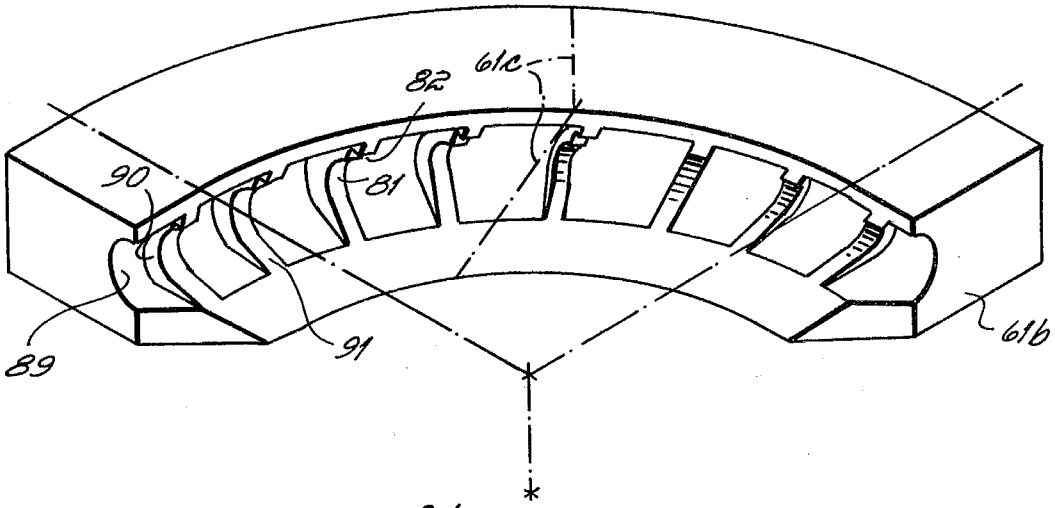
FIG. 8 is a perspective view of a die for use with a corner segment of the border wire and adjacent corner border spring.

This method by which a coil spring matrix is joined with a border wire 16 in accord with the principles of this invention is illustrated particularly in FIGS. 3–8. Initially, the border wire 16, which is of closed loop rectangular configuration, and the spring matrix, are oriented in operating proximity with a series of edge 60 and corner 61 hold down dies. The hold down die 60 is comprised of an inner die half 60*a*, and outer die half 60*b*, as shown in FIG. 7. As best seen in FIGS. 2 and 8, the corner die 61 comprises an outer member 61*b*, which is cut in half along a line 61*c*, and a pair of inner members 61*a*. These members 61*a* are simply the two end portions of inner die 60*a*.

Figure 4:
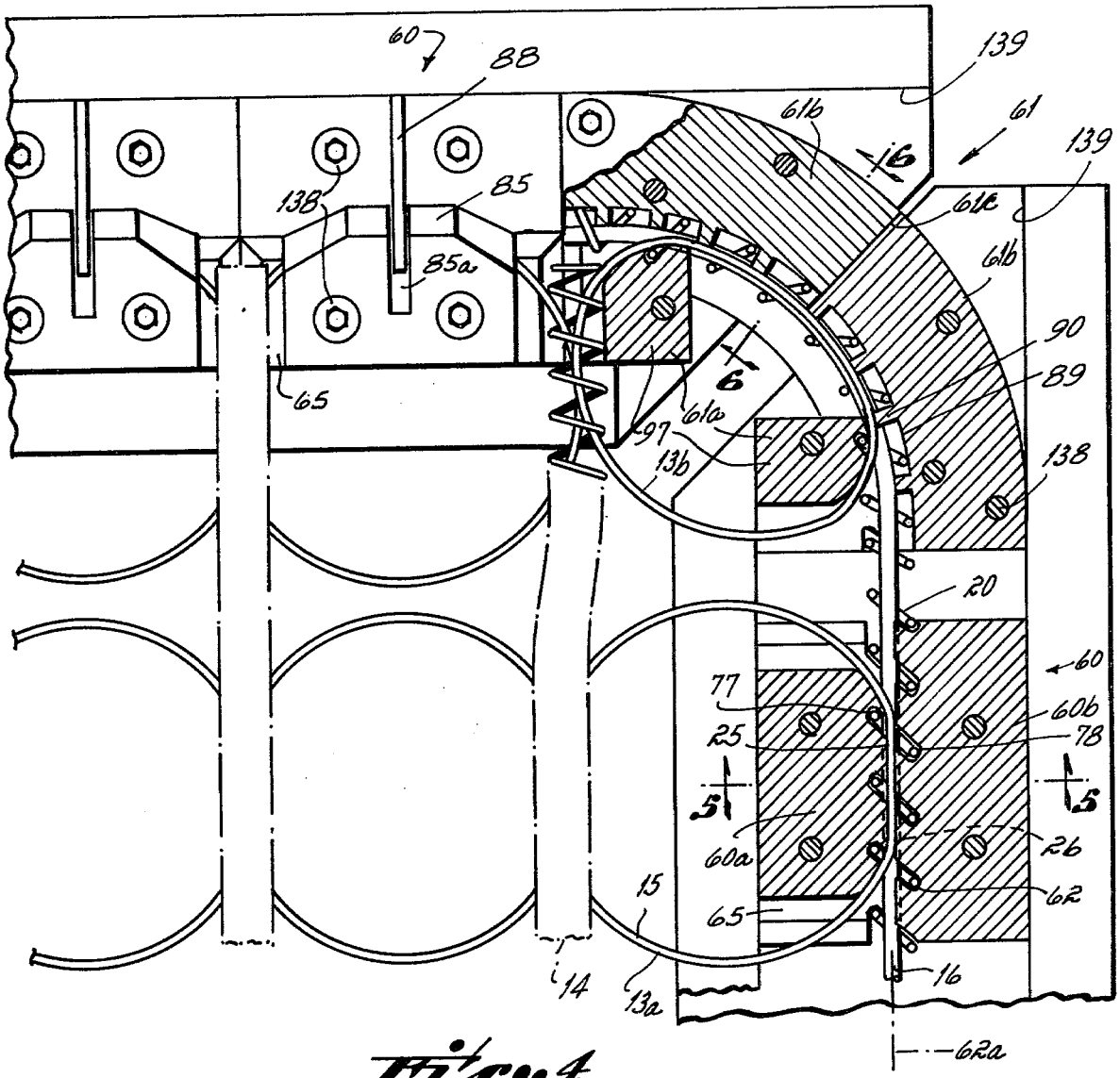
FIG. 4 is an enlarged top cross-sectional view similar to FIG. 2, but showing the border wire and border springs in deflected restrained position, relative to the hold down dies, during the lacing of the border wire with the border springs.

The hold down dies 60, 61, when closed as illustrated in FIG. 4, as opposed to when open as illustrated in FIG. 2, cooperate to define a spiral path 62. When the dies 60, 61 are closed, the border wire 16 is centered therethrough around the entire periphery of the coil spring matrix. Also when closed, the inner 60*a*, 61*a* and outer 60*b*, 61*b* die halves receive the border springs' border segments 32, 25 in deflected and aligned relation with the border wire's adjacent segments 30, 26, respectively. Thereafter, the spiral lacing wire 20 is guided around the spiral path 62 to lace or connect the border wire 16 to the border spring's face loops 15.

Figure 3:
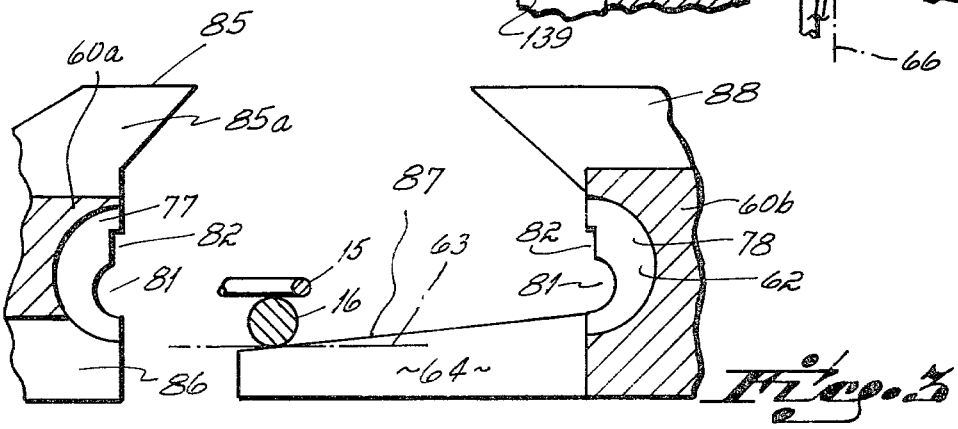
FIG. 3 is a cross-sectional view taken along line 3—3 of FIG. 2.

To assemble a mattress spring assembly 10, the coil spring matrix is initially pre-assembled from a series of coil springs 13 the rows 11 of which are connected together by spiral lacing wires 14 in known fashion. This pre-assembled coil spring matrix is one of the components of the final coil spring assembly 10 in accord with the principles of this invention. Another of the components is the closed loop border wire 16 of rectangular configuration which is initially oriented or laid in a generally horizontal plane 63 (FIG. 3), the border wire being supported in that horizontal plane by fingers 64 which extend outwardly from the edge outer die halves 60*b* as shown in FIGS. 2 and 3. With the border wire 16 laid down in place, the matrix is thereafter positioned on top the border wire 16, also as shown in FIGS. 2 and 3. The edge springs 13*a* of the matrix are positioned above the border wire 16 because those springs' face loops 15 rest on support surfaces 65 defined by the inner edge die halves 60*a*, see FIGS. 2 and 7. In this initial position the die halves of each die pair 60, 61 are, of course, open as shown in FIGS. 2 and 3 so that the closed loop border wire 16 and matrix edge 13*a* and corner 13*b* springs can be properly oriented or joggled into preferred position relative to those die halves. In this initial position, and as particularly illustrated in FIG. 2, note that the face loops 15 of the border coil springs 13*a*, 13*b* are of a circular configuration with the radius R', this initial configuration being subsequently deflected as explained in greater detail below. Also in this initial orientation, and prior to deflection of the border segments 25, 32 of the border springs 13, note that the border wire 16 is positioned interiorly of a phantom border line 66 which touches all of the border springs' face loops in tangential fashion, see FIG. 2.

Once the closed loop border wire 16 and matrix are initially positioned as illustrated in FIGS. 2 and 3, the edge 60 and corner 61 die halves are closed to a forming position illustrated in FIGS. 4–6. In this forming position, the dies 60, 61 cooperate to define a spiral path 62 around the periphery of the matrix. In this forming position the border segment 25 of each border spring's face loop 15 has been deflected out of an initial generally circular configuration as shown in FIG. 2, into a non-circular configuration having a flat chordal segment juxtapositioned against an adjacent flat segment 26 of the border wire 16. In the case of corner border springs 13*b*, the border segments 32 of the corner border springs' face loops are deflected into an arcuate attitude having a radius equal to the radius R of the arcuate corner segment 30 of the border wire 16. As with edge border springs 13*a*, the deflected arcuate segments 32 of the corner border spring 13*b* overlie the adjacent corner segments 30 of the border wire 16 in this deflected position. With the edge 13*a* and corner 13*b* border springs deflected so as to partially overlie adjacent segments 26, 30 of the border wire 16, and with the border springs' border segments 25, 32 being restrained in that deflected relationship relative to the border wire 16 by the hold-down dies 60, 61, the lacing or interconnecting of the border springs 13 with the border wire 16 through use of a spiral lacing wire 20 is the next step.

In the lacing step, a single continuous helical lacing wire 20 is introduced at one corner 24 of the rectangular spring assembly when the spring assembly's border springs are restrained in a deflected condition shown in FIG. 4. In this regard, the formed helical lacing wire 20 is fed into lacing relation with the border springs 13 and the border wire 16 from a single feed point 68 along an axis 69 coincident with the axis 62*a* defined by spiral path 62 along one edge 55 of the periphery of the spring matrix, see FIGS. 1, 4 and 5. The lacing wire 20 is rotated as it is fed into lacing relation with the border springs 13 and border wire 16, and is guided around the entire periphery of the assembly by means of the helical path 62 defined by the edge 60 and corner 61 dies. The single continuous length rotating lacing wire 20 is continuously fed and guided around the periphery of the spring matrix so as to interconnect or lace the border wire 16 with all border springs 13 on all edges 55–58 of that periphery, see FIG. 1. And the lacing wire 20 is so guided until the leading 21 and trailing 22 ends thereof are interlaced one with another relative to the closed loop configuration of the border wire 16, see FIG. 1B. In this regard, the spiral path 62 defined by the inner 60*a*, 61*a* and outer 60*b*, 61*b* die halves of the edge 60 and corner 61 dies causes the dimensional configuration of the lacing wire helix 20 to remain substantially stable or constant in both diameter and pitch from the leading end 21 to the trailing end 22 thereof during the entire lacing step. Further, and importantly, because of the retained deflected relation of the border springs' face loop border segments 25, 32 with the border wire's adjacent segments 26, 30, respectively, each of the edge border springs 13*a* is provided with a number of lacing wire turns or loops 27 equal one to the other, and each of the corner border springs 13*b* is provided with a number of lacing wire turns or loops 27 equal to the other. After the lacing wire 20 has been caused to rotate and to extend around the entire spring assembly's periphery until the leading end 21 of the lacing wire interconnects or interlaces with the trailing end 22 of that wire, the lacing wire 20 is cut from the continuous length source at trailing end 22.

After all border springs 13 have been laced with the border wire 16, the border springs' face loops segments 25, 32 are released from the deflected position shown in FIG. 4 simply by moving the die halves of the edge dies 60 and corner dies 61 out of forming relation with the spring assembly 10 formed. When so released, the border segments 25 of the edge border springs' face loops 15 return substantially to the initial circular configuration as shown in FIG. 1C, while exerting pressure by the lacing wire 20 as referred to above. However, the border segments 32 of the corner border springs' face loops 15 do not return to the initial circular configuration, but are retained by the lacing wire 20 in a non-circular configuration having an arcuate segment juxtapositioned against and of substantially the same radius R as the adjacent arcuate corner section 30 of the border wire 16 as shown in FIGS. 1A and 1B. This provides definite advantages to the mattress product so formed, as described in detail above.

BORDER LACING MACHINE

A border lacing machine 70, particularly adapted to carry out the border lacing method of this invention, and to fabricate the coil spring assembly 10 product of this invention, is illustrated in FIGS. 10–21. The edge 60 and corner 61 dies mounted or used by the machine are illustrated in FIGS. 2–7.

Figure 10:
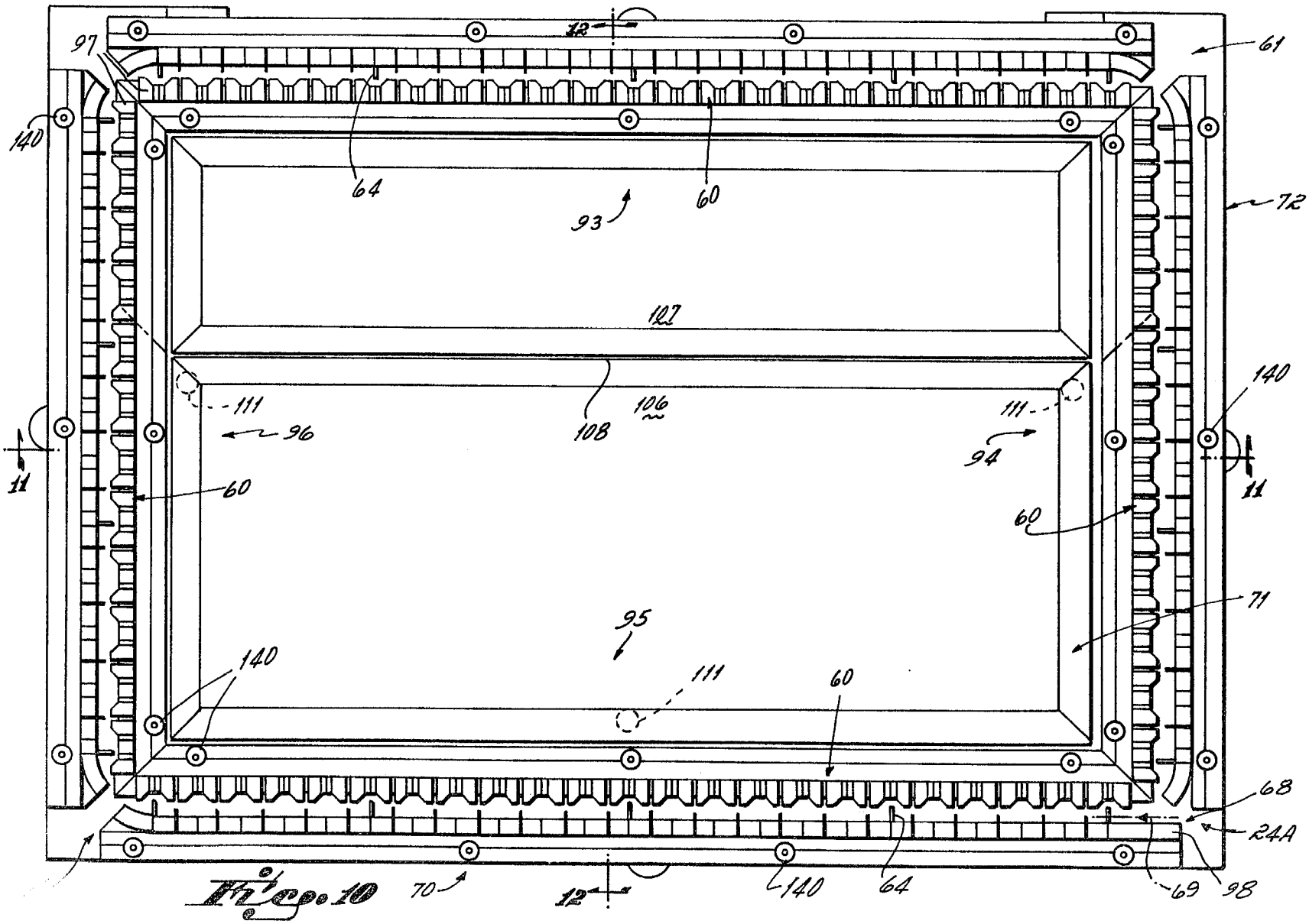
FIG. 10 is a top view of a border lacing machine adapted to fabricate the coil spring assembly shown in FIG. 1 by the method steps shown in FIGS. 2-8, the machine being shown in a first operational position adapted to produce a first width spring assembly.
Figures 11, 12, 13:
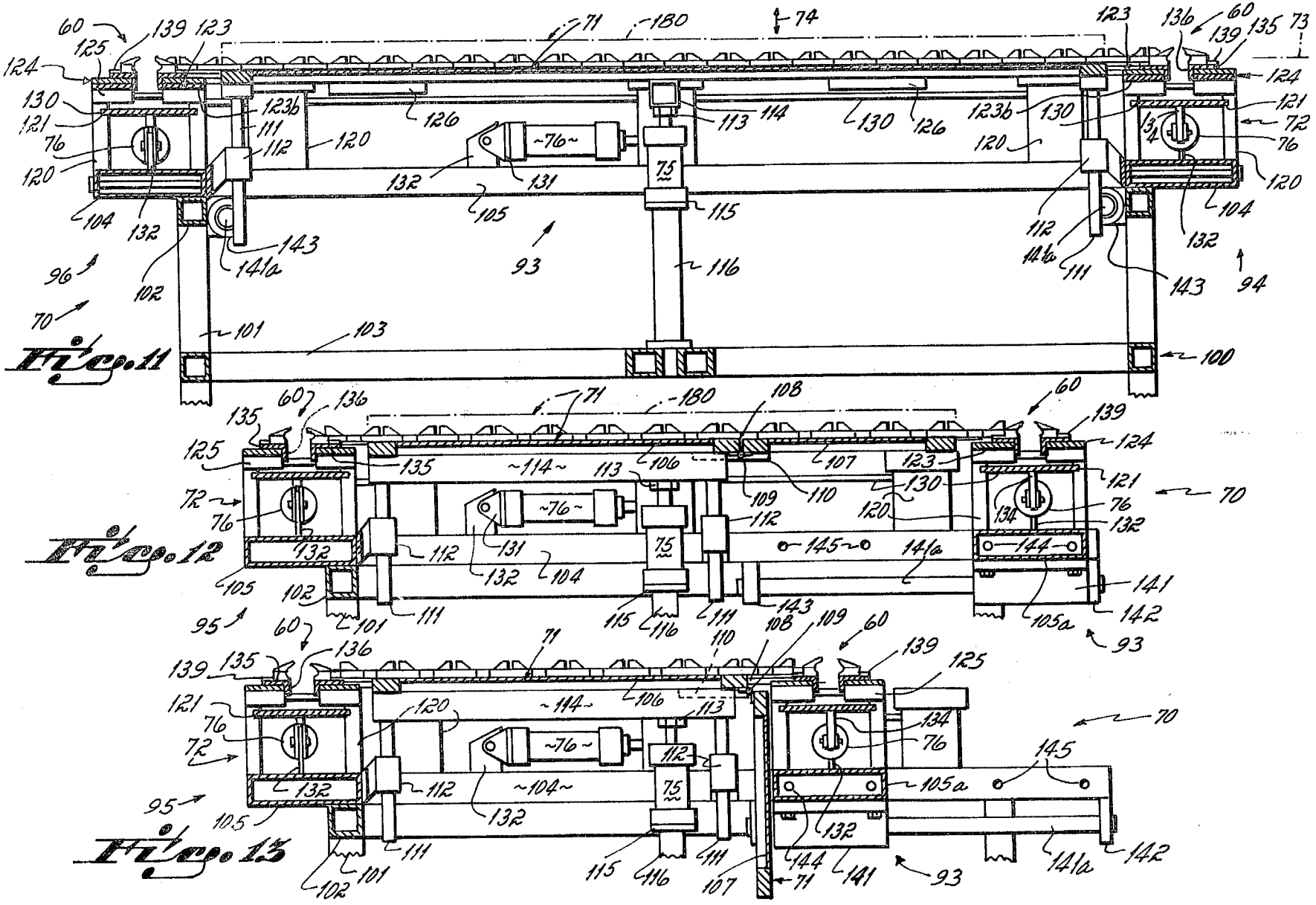
FIG. 11 is a cross-sectional view taken along line 11—11 of FIG. 10.
FIG. 12 is a cross-sectional view taken along line 12—12 of FIG. 10.
FIG. 13 is a cross-sectional view similar to FIG. 12, but showing the machine in a second operational position adapted to produce a second narrow width spring assembly.

The border lacing machine 70 basically includes a vertically movable center table 71 and a vertically stationary peripheral frame like table 72. The peripheral frame like table 72 is provided with a series of edge 60 and corner 61 dies which extend around the entire periphery of the center table 70 in closed loop configuration which, as shown in FIGS. 10–12, is sized to fabricate a spring assembly 10 of a particular size. Each of the dies 60, 61 is comprised of an inner die half 60*a*, 61*a* and an outer die half 60*b*, 61*b*, both die halves being movable relative one to another in a horizontal plane 73, but non-movable in a vertical plane. The machine's center table 71 provides a support for a coil spring matrix and the center section is vertically movable, as shown by phantom arrow 74. In use, and with the center table 71 upraised into the phantom line position shown in FIG. 11, a spring matrix is positioned thereon after a closed loop border wire 16 has been located on the opened edge dies' support fingers 64. The spring matrix is thereafter lowered by lowering the center table 71 through use of fluid motor 75 into the FIG. 11 solid line position, that lowering causing the edge coil springs' face loops 15 to be centered relative to the edge 60 and corner 61 dies, and to be supported on support surfaces 65 of the edge dies 60, with the dies 60, 61 remaining in the open position, see FIGS. 2 and 3. Subsequently, the dies 60, 61 on peripheral table 72 are moved horizontally into gripping or forming relation with the border coil springs' face loops 15 and border wire 16 by fluid motors 76 into the forming position shown in FIGS. 4, 5 and 6. At this point, a helical lacing wire 20 is introduced into helical path 62 formed by the hold down dies 60, 61 and caused to rotate around the entire periphery 18 of the spring matrix as guided by the spiral path defined by the hold down dies to form the product illustrated in FIG. 1.

Each of the edge dies 60, as illustrated in FIGS. 2, 3, 5 and 7, is comprised of an inner die half 60*a* and an outer die half 60*b*, a series of those dies equal to the number of edge coil springs 13*a* on each edge 55–58 of the coil spring matrix being provided on each respective side edge of the machine 70. Each of the edge die halves 60*a*, 61*b* provides a series of cooperating slanted grooves 77, 78 on the respective inner faces thereof, which grooves cooperate to define a spiral path 62 as shown in FIG. 4. Each of the die halves 60*a*, 60*b* also includes a border wire groove 81 and a coil wire groove 82 which are parallel one to the other, and positioned vertically above one another, and which cooperate to define a closed border wire groove and a coil wire groove when the die halves are in forming relation, compare FIGS. 2 and 3 with FIGS. 4 and 5. Note the center lines 83, 84 of the grooves 81, 82 when the inside 60*a* and outside 60*b* die halves are in forming relation lie in a common vertical plane 79. Each of the inner die halves 60*a* also defines the horizontal support surface 65 for an edge border spring's face loop 15, see FIGS. 2, 4 and 7, when the spring matrix 17 is positioned on the machine 70 prior to the die halves 60*a*, 60*b* being closed in forming relation. It is these support surfaces 65 that locate the edge border springs' face loops 15 in aligned relation with the dies' coil wire grooves 82 through cooperation with crowns 85 on the inner die halves 60*a*. A support finger 64 is connected to a spaced plurality of outer die halves 60*b* in a position generally normal to the border wire 81 and coil wire 82 grooves formed by the die half 60*b*. This support finger 64 extends generally between the inside 60*a* and outside 60*b* die halves when the die 60 is open, and is received in slot 86 formed in the inner die half 60*a* when the inside and outside die halves are moved into forming relation. The support finger 64, which is provided only on spaced edge dies 60 and not on every edge die, supports the closed loop border wire 16 in proper orientation with the dies 60, 61 during set-up of the machine 70, and upper cam surface 87 of the support finger causes the border wire 16 loop to be cammed upwardly into the border wire grooves 81 formed by the closed inside 60*a* and outside 60*b* die halves as those dies are closed from the FIG. 3 position to the closed FIG. 5 position, i.e., support fingers 64 are received in slots 86 when the two die halves are moved toward one another. Thus, inside dies' horizontal support surfaces 65 for the coil springs' face loops 15 and the outside dies' support fingers 64 for the border wire 16 cooperate to orient the border wire and the edge border spring face loops' border segments 25 in proper aligned position within the border wire groove 81 and coil wire groove 82. The die half 60*a* also includes a transverse slot 85*a* (relative to the forming grooves 81, 82) in crown 85, and the outside die half includes an upstanding ear 88 aligned with that slot. This ear 88 and slot 85*a* structure insures alignment of the inside 60*a* and outside 60*b* die halves as they are closed into forming relation during use of the machine.

Three of the corner dies are identical one with another, and the fourth corner 24A die has its own structure. The three identical corner dies are shown in FIGS. 2, 4, 6 and 8. Each of these three corner dies comprises the outside die half 61*b* of arcuate configuration which is split centrally thereof on a radial line 61*a* (compare FIGS. 2 and 4). One-half section of the outside die is carried on one side edge section of the peripheral frame 70 and the other half section of that outside die is carried on another side edge section of the peripheral frame 70. As best seen in FIGS. 4 and 8, the die half 61*b* has an arcuate recess 89 divided by lands 90. The lands 90 have border wire grooves 81 and coil wire grooves 82 on their inner surfaces. Each land is also provided with a cam edge 91 to guide the border wire into its groove. The spacing of the lands 90 in recess 89 is such that the pitch P of the lace wire 20 will wind within the recess between the lands. The inside die half 61*a* of the three identical corner dies is comprised of, in effect, the analogous half 97 of an inside edge die half 60*a*, at each end of the inside corner die half 61*a*, but with no die section connecting those half sections of the inside die half 61*a*. As with the half sections of the outside die half 61*b*, one-half section of the inside die half 61*a* is carried on one side edge section of the peripheral frame, and the other half section of that inside die half 61*a* is carried on another side edge section of the peripheral frame 70. The inside corner die half 61*a* cooperates with the outside corner die half 61*b* as shown in FIGS. 4 and 6. Thus, when the inside 61*a* and outside 61*b* corner die halves are closed relative one to another, the spiral path 62 so defined is really only partially defined, and partially defined only by the outside die half 61*b* as shown in FIGS. 4 and 6 except for the inside die half sections 97 at the entrance and exit to the corner. This corner die 61 structure eliminates some degree of friction or drag resistance of the helical lacing wire 20 as it traverses the three corner dies from one end to the other.

The one corner 24A die of special configuration, as is shown in FIG. 10, is the same as the dies that serve the other corners with the exception that it constitutes only one-half of an outside corner die 61*b*. In other words, one of the half sections of the outside die half 61*b* of a corner 24A die is eliminated and replaced by a die member 98 which guides the lacing coil 20 into the edge dies 60 and causes the lacing wire to overlap at the ends. This corner 24A presents an infeed station at corner 24 of the spring matrix (and, therefore, at a corner of the hold down die 60, 61 loop) by which the helical lacing wire 20 can be rotated and fed from its source 68 into guided relation with the helical guide path 62 defined by the inside and outside hold down dies.

The hold down dies 60, 61 are mounted on a vertically stationary peripheral frame 70 (comprised of four edge stations 93–96) that surrounds the vertically movable center table 71, all of which is mounted on a stationary machine frame 100. The machine frame 100, as shown in FIG. 11, includes corner posts 101, upper cross frame braces 102, and lower cross frame braces 103. End edge 104 and side edge 105 support braces, which are fixed to the main frame 100, support the horizontally movable die frame 70.

The vertically movable center table 71 is comprised of a primary table section 106 and an auxiliary table section 107 which are pivotally connected one to another along hinge line 108 by hinges 109, see FIGS. 12 and 13. When both table sections 106, 107 are pivotally connected in a common horizontal plane as shown in FIGS. 10–12, the border lacing machine 70 is adapted to lace a border wire 20 onto a matrix 17 of one width. When the auxiliary table section 107 hangs down vertically as shown in FIG. 13, the modified machine is adapted to lace a border wire 20 onto a spring matrix of a different width. The auxiliary table section 107 is retained in horizontal relation with the primary table section 106 by retractable slide bolt 110.

The primary section 106 of the center table 70 is mounted with three vertical guide posts 111, the guide posts being slidably received in table guide blocks 112 mounted to the stationary table frame 100, see FIGS. 10–12. The table 70 is vertically movable through use of vertically oriented fluid power cylinder 75 connected at one end 113 to frame member 114 of the table section 106, and at the other end 115 to mounting post 116 fixed to the machine frame 100. Operation of the fluid power cylinder 75 by a control circuit (not shown) permits the table 71 to be vertically moved between an elevated position shown in phantom line in FIGS. 11 and 12 in which the table is positioned to receive the new coil spring matrix from, or release a newly fabricated mattress assembly 10 to, an operator. In the upper or elevated position, and when a new spring matrix is received on the table 70, the matrix can be easily moved or jogged into proper position so as to preliminarily orient the border springs 13 above the respective hold down dies 60, 61.

Figure 14:
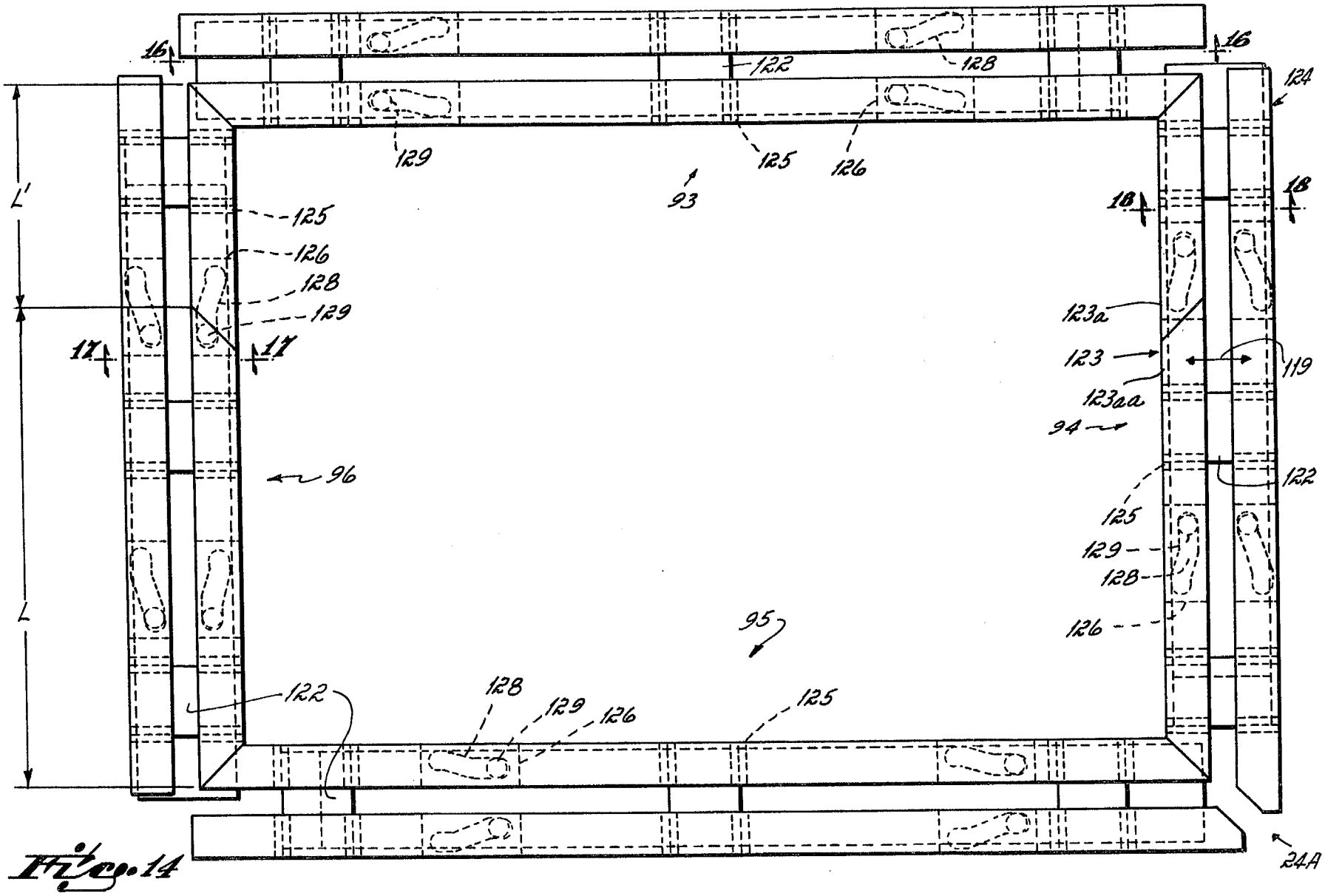
FIG. 14 is a top view similar to FIG. 10, but with the hold down dies and several members removed for clarity, and showing the machine in the die opened position.
Figure 15:
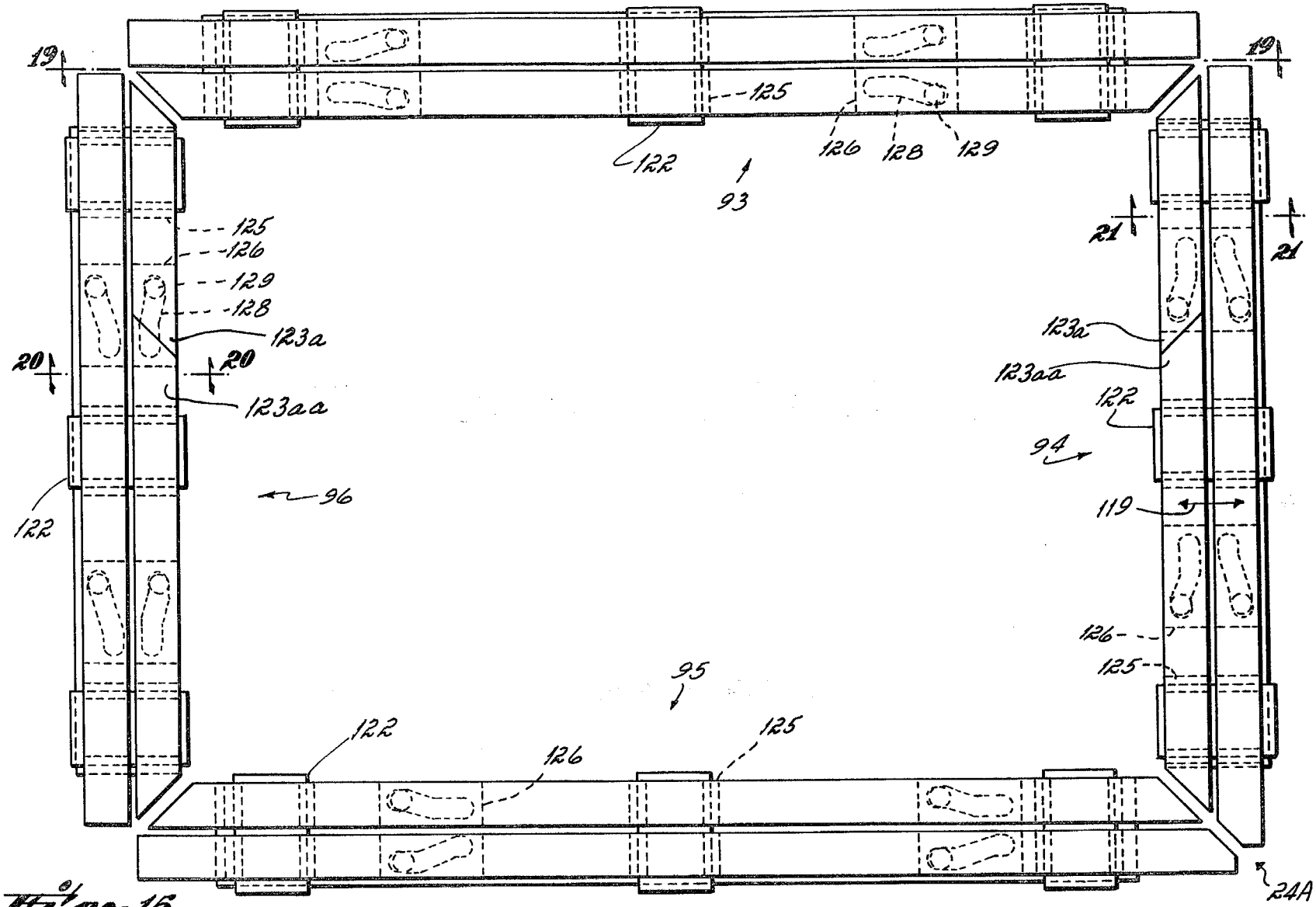
FIG. 15 is a view similar to FIG. 14, but showing the machine in the die closed position.
Figure 16:
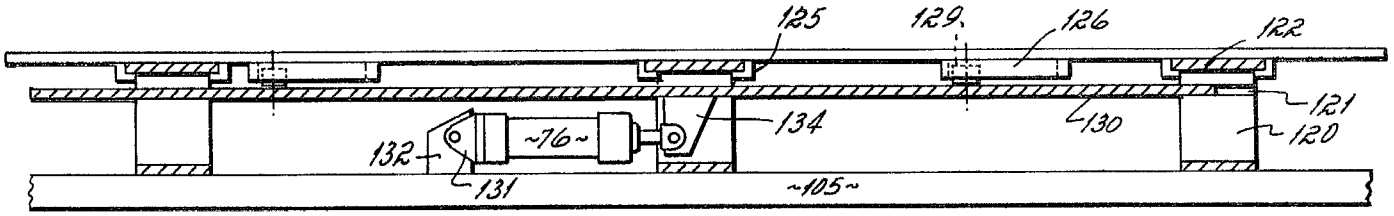
FIG. 16 is a cross-sectional view taken along line 16—16 of FIG. 14.
Figure 18:
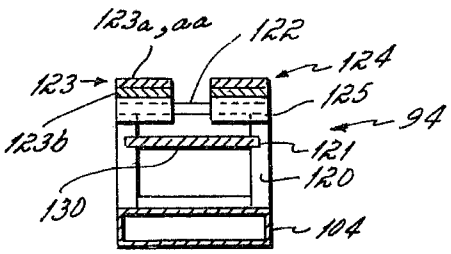
FIG. 18 is a cross-sectional view taken along line 18—18 of FIG. 14.
Figure 17:
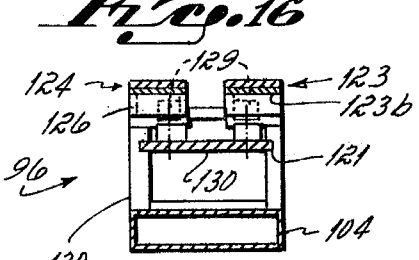
FIG. 17 is a cross-sectional view taken along line 17—17 of FIG. 14.
Figure 19:
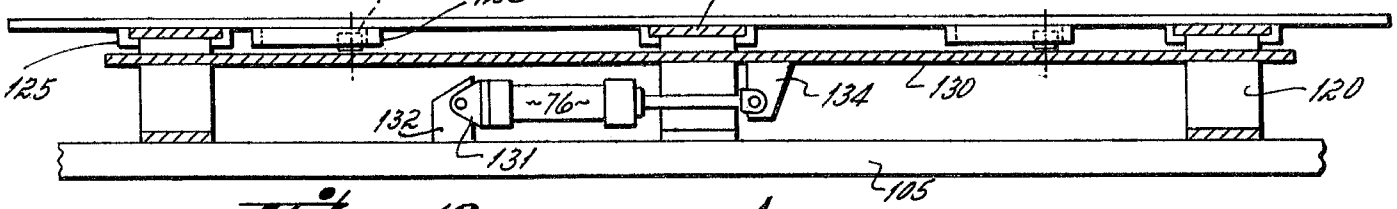
FIG. 19 is a cross-sectional view taken along line 19—19 of FIG. 15.
Figure 21:
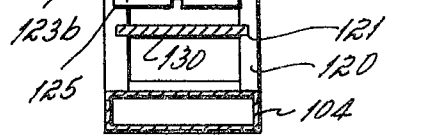
FIG. 21 is a cross-sectional view taken along line 21—21 of FIG. 15.
Figure 20:
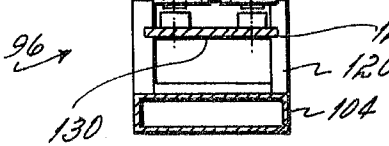
FIG. 20 is a cross-sectional view taken along line 20—20 of FIG. 15.

The peripheral or border table 71 which mounts the hold down dies 60, 61 is in effect four separate frame sections 93–96, one for each edge 71–74 of the spring assembly 10 to be constructed on the machine 70, see FIGS. 10 and 14. Each of the end edge frame sections 94, 96 of the border table 71 is mounted on the stationary tubular end supports 104 fixed to the machine frame 100. Each stationary tubular support mounts a series of pairs of power plate guide posts 120 along its length from one end to the other, these guide posts defining notches 121 adjacent the top ends thereof, see FIGS. 11, 12 and 18. A cross guide rail 122 is fixed between the top ends of each pair of power plate guide posts 120 as shown in FIG. 16. Inner 123 and outer 124 die carrier rails are slidably received on the cross guide rails 122, the inner and outer die carrier rails extending the length of the edge 94, 96 which they serve, see FIGS. 11 and 14. Each of the inner rails 123 is comprised of an upper two-piece rail **123*a*, 123*aa* and a lower shim rail 123*b*, see FIG. 14. The lower shim rail 123*b* underlies the entire combined length L of rail 123*aa* and the length L′ of the rail 123*a*. The upper rail segment 123*a* is removable for a purpose described in detail below. As seen in FIGS. 16–18, these inner 123 and outer 124 die carrier rails mount on their under surfaces guide brackets 125 adapted to embrace the cross guide rails 122 so as to maintain alignment of the die carrier rails in their inner and outer movement relative one to another as shown by arrow 119**.

Also as to each of the end edge frame sections 94, 96, the inner 123 and outer 124 die carrier rails are each provided, on the underside, with two cam plates 126, one adjacent each end thereof. The two cam plates 126 each define a cam track 128 sized to receive a roller 129 that is fixed to a die power plate 130. Longitudinal motion of this die power plate 130 induces open/close motion (see arrow 119) of the die carrier rails 123, 124 (and, thereby, of the hold down dies 60, 61 mounted thereon as described in greater detail below) because of the inter-action between the die power plate's cam rollers 129 and the die carrier rails' cam tracks 128, compare FIG. 14 to FIG. 15. Longitudinal motion of the die power plate 130 is accomplished through use of a fluid power cylinder 76 fixed at one end 131 to ear 132 on the stationary machine frame 104 and pinned at the other end to ear 134 fixed to the die power plate, see FIG. 11.

The die carrier rails 123, 124 each carry an angled die mounting plate 135 having a vertical foot 136 that extends over the inside edges of the die carrier rails, thereby positively locating the die halves of each hold down die 60, 61 pair in a closure relation shown in FIG. 5 when the die carrier rails are in the closed position shown in FIGS. 15 and 19–21. The hold down die halves 60, 61 are mounted to the angled die plates 135 by bolts 138 (FIG. 2) and are backed by backing strips 139 also fixed to the die rails. The backing strips 139 are held in position by any suitable means such as by a bolt washer 140 as shown in FIG. 10. When the border lacing machine 70 is structured for fabrication of the larger size spring assemblies as illustrated in FIG. 10, the die mount plates 135 and the die carrier rails 123, 124 are as shown in all figures except FIG. 13.

It is the end edge sections' die carrier rails 123, 124 (and, therefore, die mount plates 135) that are changed when the machine 70 is to be set up for a smaller width spring assembly. This change is effected by removing the die mount angles 135 (with hold down dies 60 attached thereto) as a sub-assembly. The upper carrier rail sections **123*a* may then be removed. After the rails 123*a* are removed a sub-assembly (not shown) of die mount angles and dies 60** which is similar in construction to the removed sub-assembly is substituted. This similar sub-assembly is of a length L that will produce a smaller width unit.

The side edge sections 93, 95 of the border table 71 are identical to the end edge sections 94, 96 of the table 71 with certain exceptions, common (except for size) parts being provided with common reference numbers. The primary difference is that one side edge section 93 of the border table 71 is movable in a horizontal path toward and away from the opposite side edge section 95 of the border table 71. In this regard, the edge section 93 of the border table 71 is mounted on a movable tubular support **105*a* in the same manner as the other side section 95 and the end sections 94, 96 of the die frame border table 71 are mounted on fixed tubular supports 105 and 104. But this tubular support 105*a* is itself bolted to a horizontally movable carriage 141. This carriage 141, as shown in FIGS. 12 and 13, is slidable on horizontal guide rods 141*a* fixed to each end to the table frame 100, thereby permitting the carriage (and, hence, the side edge section 93) to move between the wider width position shown in FIG. 12 and the narrower width position shown in FIG. 13. The guide rods 141***a* are fixed to the frame at the outer end by ear 142 mounted to the immobile stationary frame 100, and at the inner end by ear 143 mounted to the stationary frame. The carriage 141 is held in position on the stationary frame 100 at the desired location on the guide rods 141*a* by interaction of locator pins 144 which extend through bores 145 in immobile end edge tubular supports 104 into locking relation with the movable tubular frame support 105*a*, see FIGS. 11–13.

In use, the border lacing machine 70 is initially positioned as illustrated in FIGS. 10–12, 14 and 16–18. In this initial position, the hold down dies 60, 61 are open as shown in FIGS. 2 and 3. This open position of the hold down dies 60, 61 is achieved because the inner 123 and outer 124 die carrier rails of each of the peripheral table's edge sections 93–96 are moved into the position shown in FIGS. 14 and 16–18 through counterclockwise movement of the die power plates 130, which movement is powered by the four fluid power cylinders 76 attached between the machine frame 100 and the die power plates 130. The power plates' cam rollers 129 cooperate with the die carrier rails' cam tracks 128 of the inner 123 and outer 124 die carrier rails. In this open die 60, 61 position, of course, the opposed die halves of the edge 60 and corner 61 hold down dies are spaced as shown in FIG. 10 since the die 60, 61 halves are mounted on the die carrier rails 123, 124. The inner 123 and outer 124 die carrier rails are guided in open/close motion relative one to another by virtue of the rails' guide brackets 125 cooperating with cross guide rails 122 fixed to power plate guide posts 120 as shown in FIG. 16.

In the initial or die open position, also, the vertically movable table 71, as guided by table guide posts 111 cooperating with stationary frame guide blocks 112, is upraised to the elevated position shown in phantom line 180 in FIGS. 11 and 12 by the vertical fluid power cylinder 75. With the machine 70 in this attitude, the closed loop border wire 16 for the assembly 10 is first introduced into proper orientation with the open die 60, 61 halves, the border wire then resting upon support fingers 64 fixed to the outer edge dies 60*b*. Subsequently, a coil spring matrix (comprised of rows 11 of coil springs 13 connected together by spiral lacing wires 14) is introduced onto the elevated table, and preliminarily shifted thereon until the coil springs' face loops 15 generally overlie the related edge 60 and corner 61 forming dies. Subsequently, the table 71 is lowered through use of the vertical fluid power cylinder 75 into the forming or lower position shown in solid lines in FIGS. 11 and 12. In this position the coil springs' face loops 15 overlie the border wire 16 previously oriented in position on the edge die halves' support fingers 64, the coil springs' face loops being held in this position by the inner die halves' support surfaces 65, see FIGS. 2, 3 and 7. The machine 70 is now positioned relative to the coil spring matrix and the border wire 16 for closure of the die 60, 61 halves.

The die halves 60, 61 are closed into forming relation through use of the four fluid power cylinders 76 connected with the four sections 93–96 of the peripheral table 70. Upon activation, these fluid power cylinders 76 move the four die power plates 130 clockwise from the FIG. 14 open position to the FIG. 15 closed position. This motion of the die power plates 130 induces closing motion of the die carrier rails 123, 124 toward one another as the cam rollers 129 carried on the die power plates 130 interact with the cam plates 128 fixed to the underside of the die carrier rails. The closing motion of the die carrier rails 123, 124 toward one another (and, hence, of the die halves 60, 61 mounted thereon) is controlled through interaction of the die carrier rails' guide brackets 125 with the cross guide rails 122 fixed to the immobile power plates' guide posts 120. As the inner 123 and outer 124 die carrier rails move toward one another, the support fingers 64 on the outer die halves 60*b* enter opposed slots 86 on the inner die halves 60*a* of the edge hold-down dies 60 so as to cam the border wire 16 up into the border wire groove 81 formed by the edge die halves, compare FIG. 3 to FIG. 5. Further, the inner 60*a* and outer 60*b* edge die halves cooperate to deflect each of the border segments 25 of the edge border springs' face loops 15 into generally linear relation overlying the adjacent border wire segment 26 also in the die, compare FIG. 2 to FIG. 4. Further, the border segments 32 of the corner border springs' face loops 15 are deflected, due to the inherent spring nature of that face loop, against the coil wire groove 82 defined in the corner dies 61, see FIGS. 2, 4 and 6. With the hold-down dies 60, 61 so closed, the machine 70 has now deflected and restrained the face loops 15 of the edge border springs 13 into prospective lacing relation with the border wire 16.

The helical lacing wire 20 is produced and formed by any conventional helical wire machine known to the prior art. The helical lacing wire 20 is simultaneously rotated and introduced into the spiral groove 62 formed by the hold-down dies 60, 61. The spiral lacing wire 20, being of a single continuous length, is therefore guided around the entire periphery of the now closed hold-down dies 60, 61 as directed by the spiral guide path 62 defined by those dies until the leading end 21 of the wire interlaces with a trailing end 22 of the wire as shown in the finished mattress product illustrated in FIG. 1. At that time, the hold down dies 60, 61 of the border lacing machine 70 are opened, the center table 71 upraised, and the finished coil spring assembly 10 removed from the table 71.

Having described in detail the preferred embodiment of my invention, what I desire to claim and protect by Letters Patent is:

1. A method of joining a generally rectangular coil spring matrix and rectangular border wire, said matrix including a plurality of rows of coil springs having end loops located in a common plane, said matrix having corner and edge coils springs located around the peripheral edge of said matrix, said method comprising the steps of locating said border wire in close adjacency to the outer peripheral segments of said end loops of said corner and edge coil springs, deflecting a border segment of at least one end loop of one of said corner coil springs out of an initial configuration into a different configuration in which said border segment of said end loop of said corner coil spring is contiguous to and of approximately the same radius as an adjacent corner segment of said border wire, wrapping a single helical lacing wire around said border wire and around said deflected segment of said end loop of said corner coil spring and around the outer peripheral segments of end loops of edge coil springs located along two sides of said matrix which are adjacent said deflected segment of said corner coil spring while maintaining the border segment of said end loop of said corner coil spring deflected into said different configuration, and releasing said corner coil springs' end loop segment from said deflected configuration after lacing the end loops of coil springs of said two sides and one corner to said border wire.

2. A method of joining a generally rectangular coil spring matrix and rectangular border wire, said matrix including a plurality of rows of coil springs having end loops located in a common plane, said matrix having corner and edge coil springs located around the peripheral edge of said matrix, said method comprising the steps of locating said border wire in close adjacency to the outer peripheral segments of said end loops of said corner and edge coil springs, deflecting a border segment of at least one end loop of one of said corner coil springs out of an initial configuration into a different configuration in which said border segment of said end loop of said corner coil spring is contiguous to and of approximately the same radius as an adjacent corner segment of said border wire, deflecting a border segment of the end loops of side edge coil springs located along two sides of said matrix which are adjacent said deflected segment of said corner coil spring into a different configuration in which said deflected border segments of said side edge coil springs are generally flat and contiguous to a segment of said border wire;

wrapping a single helical lacing wire around said border wire and around said deflected segments of said side edge and corner coil spring while maintaining the border segments of said side edge and corner coil springs deflected into said different configurations, and releasing said corner and side edge coil springs' end loop segments from said deflected configurations after lacing the end loops of said two sides and one corner to said border wire.

3. A method of joining a generally rectangular coil spring matrix and rectangular border wire, said matrix including a plurality of rows of coil springs having end loops located in a common plane, said matrix having corner and edge coil springs located around the peripheral edge of said matrix, said method comprising the steps of locating said border wire in close adjacency to the outer peripheral segments of said end loops of said corner and edge coil springs, deflecting border segments of end loops of said corner coil springs out of an initial configuration into a different configuration in which said deflected border segments of said corner coil springs are contiguous to and of approximately the same radius as an adjacent corner segment of said border wire, wrapping helical lacing wire around said border wire and around said deflected segments of said corner coil springs and around the outer peripheral segments of end loops of edge coil springs located along the sides of said matrix while maintaining the border segments of said end loops of said corner coil spring deflected into said different configuration, and releasing said corner coil springs' deflected segments from said deflected configuration after lacing the end loops of said corner and side edge coil springs to said border wire.

4. A method of joining a coil spring matrix and rectangular border wire to form a spring assembly, said matrix including a plurality of rows of coil springs having end loops located in a common plane, said matrix having corner and side edge coil springs located around the peripheral edge of said matrix, said method comprising the steps of locating said border wire in close adjacency to the outer peripheral border segments of said end loops of said corner and edge coil springs, deflecting said border segments of said corner coil springs out of an initial configuration into a different configuration in which said border segments of said corner coil springs are contiguous to and of approximately the same radius as an adjacent corner segment of said border wire, deflecting said border segments of said side edge coil springs into a different configuration in which said deflected border segments of said side edge coil springs are generally flat and contiguous to a segment of said border wire;

wrapping helical lacing wire around said border wire and around said deflected segments of said side edge and corner coil springs while maintaining the border segments of said side edge and corner coil springs deflected into said different configurations, and releasing said corner and side edge coil springs' end loop segments from said deflected configurations after lacing the end loops of said sides and corner coil springs to said border wire.

5. The method as set forth in claim 4, said method comprising the step of lacing each of said deflected segments of said side edge springs and said border wire with a number of lacing wire turns equal one to the other, and lacing each of said deflected segments of said corner coil springs and said border wire with a number of lacing wire turns equal one to the other and greater than the number of turns used to lace said side edge border springs with said border wire.

6. The method as set forth in claim 4, wherein a single continuous helical lacing wire is wrapped around the four sides of said rectangular border wire and the deflected segments of said corner and said side edge coil springs.

7. A method as set forth in claim 6, said method including the step of interlacing the leading and trailing ends of said lacing wire one with another.

8. The method as set forth in claim 4, wherein said lacing step comprises feeding a formed helical lacing wire into lacing relation with said corner and side edge coil springs and said border wire from a single feed point, said lacing wire being rotated as it is fed into lacing relation with said border springs and said border wire.

9. The method as set forth in claim 8, said lacing step further comprising the step of guiding said rotating lacing wire around the entire periphery of said matrix without stopping rotation of said lacing wire while continuously feeding said lacing wire into lacing relation with said corner and side edge coil springs.

10. The method as set forth in claim 4, wherein said locating method step comprises locating said border wire and corner and side edge coil springs relative to die halves that define a helical path about the periphery of said coil spring matrix, said helical path embracing said border wire and said border segments of said corner and side edge coil springs.

11. The method as set forth in claim 10 wherein said locating step comprises centering adjacent side edge coil springs on axes evenly spaced one from another during said deflecting and lacing steps.

12. The method as set forth in claim 4 wherein said deflecting step comprises providing die halves that cooperate one with another to define a helical path for said helical lacing wire, and moving said die halves into helical path defining relation one with another about said border wire and said border segments of said corner and side edge coil springs, said die halves simultaneously deflecting said border segments of said corner and coil springs in the course of moving into said helical path defining relation.

13. A method of joining a generally rectangular coil spring matrix with a generally rectangular border wire to form a coil spring assembly, said matrix including a series of corner and side edge coil springs located around the peripheral edge of said matrix, said coil springs having end loops located in a common plane, said method comprising orienting said border wire in close adjacency with peripheral segments of said end loops of said corner and side edge coil springs, moving dies into helical path defining relationship one with the other about said border wire and said border segments of said corner and side edge coil springs, feeding a formed rotating lacing wire into lacing relationship with said border wire and said peripheral segments of said corner and coil springs by guiding said rotating lacing wire through the helical path defined by said dies.

14. The method of claim 13 in which a single lacing wire is guided through said dies until the leading and trailing ends thereof are juxtaposed one with another after having passed completely around the periphery of said coil spring assembly.

15. The method of claim 13 in which said lacing wire is guided around each of said peripheral segments of said side edge coil springs and said border wire with a number of lacing wire turns equal one to the other.

16. The method of claim 15 in which said lacing wire is guided around the peripheral segments of each of said corner coil springs and said border wire with a number of lacing wire turns equal one to the other and greater in number than the number of turns used to lace said side edge coil springs with said border wire.

17. The method as set forth in claim 13, including the step of deflecting the peripheral segment of each corner and side edge coil spring out of an initial configuration into a generally continuous relationship with an adjacent segment of said border wire during the feeding of the lacing wire into lacing relationship with said border wire and said corner and side edge coil springs.

18. The method of claim 17 in which said peripheral segments of said side edge coils are deflected into a generally linear configuration and said peripheral segments of said corner coils are deflected into a generally arcuate configuration of approximately the same radius as the corners of said border wire.

19. The method of claim 18 in which said dies in the course of moving into helical path defining relationship one with the other simultaneously deflect the peripheral segments of said corners and side edge coil springs.

20. A coil spring assembly comprising a spring matrix, a border wire, and lacing wire, said matrix comprising a plurality of rows of coil springs having end loops located in a common plane, said matrix having corner and edge coil springs located around the peripheral edge of the matrix, said border wire having sides and corners located in close adjacency to border segments of the end loops of said edge and corner coil springs, and said lacing wire being generally helical in configuration and being wrapped around said border wire and said border segments of said corner and edge coil springs to connect said border wire to said corner and edge coil springs, said lacing wire being operative to maintain the border segment of said corner coil springs in a deflected arcuate configuration contiguous to an arcuate corner section of said border wire, said deflected arcuate border segment of said corner coil springs being of different radius from the remainder of said end loop of said corner coil springs, said spring assembly being manufactured by the method of locating said border wire in close adjacency to the outer peripheral border segments of said end loops of said corner and edge coil springs, deflecting said border segments of said corner coil springs out of an initial configuration into a different configuration in which said border segments of said corner coil springs are contiguous to and of approximately the same radius as an adjacent corner segment of said border wire, wrapping said helical lacing wire around said border wire and around said border segments of said edge coils and around said deflected segments of said corner coil springs while maintaining the border segments of said corner coil springs deflected into said different configurations, and releasing said corner coil springs end loop segments from said deflected configurations after lacing the end loops of said sides and corner coil springs to said border wire.

21. The coil spring assembly as set forth in claim 20, said border wire being of a generally closed loop configuration, and said lacing wire being of a continuous one-piece length extending completely around the periphery of said spring assembly.

22. The coil spring assembly as set forth in claim 21, wherein the trailing end of said lacing wire is interlaced with the leading end of said lacing wire.

23. The coil spring assembly as set forth in claim 20, wherein the deflected configuration of said border segment of said corner coil springs is of approximately the same radius as the adjacent segment of said border wire and the remainder of said end loops of said corner coil springs is of substantially greater radius.

24. The coil spring assembly as set forth in claim 20, wherein all edge coil springs of said assembly are connected to said border wire by an equal number of helical wraps of said lacing wire.

25. A coil spring assembly comprising a spring matrix, a border wire, and a lacing wire, said matrix being generally rectangular and comprising a plurality of rows of coil springs having end loops located in a common plane, said matrix having corner and edge coil springs located around the peripheral edge of the matrix, said border wire being generally rectangular and having flat sides and arcuate corners located in close adjacency to border segments of the end loops of said edge and corner coil springs, and said lacing wire being generally helical in configuration and being wrapped around said border wire and said border segments of said corner and edge coil springs to connect said border wire to said corner and edge coil springs, said lacing wire being operative to maintain the border segment of said corner coil springs in a deflected arcuate configuration contiguous to and of approximately the same radius as said arcuate corner of said border wire, said lacing wire being of a single continuous one-piece length which extends completely around the entire periphery of said assembly, said spring assembly being manufactured by the method of locating said border wire in close adjacency to the outer peripheral border segments of said end loops of said corner and edge coil springs, deflecting said border segments of said corner coil springs out of an initial configuration into a different configuration in which said border segments of said corner coil springs are contiguous to and of approximately the same radius as an adjacent corner segment of said border wire, wrapping said helical lacing wire around said border wire and around said border segments of said edge coils and around said deflected segments of said corner coil springs while maintaining the border segments of said corner coil springs deflected into said different configurations, and releasing said corner coil springs end loop segments from said deflected configurations after lacing the end loops of said sides and corner coil springs to said border wire.

26. The coil spring assembly of claim 25 in which the two ends of said lacing wire are interlaced around said border wire.

27. The coil spring assembly as set forth in claim 25, wherein the end loop of said edge coil springs are all generally circular in configuration and the end loops of said corner coil springs are all non-circular 28. The coil spring assembly of claim 27 in which the radius of the deflected segments of the corner coil springs is less than the radius of the remainder of the end loops of the corner coils.

29. A coil spring assembly comprising a spring matrix, a border wire, and lacing wire, said matrix comprising a plurality of rows of coil springs having corner and edge coil springs located around the peripheral edge of the matrix, each of said coil springs having an end loop located in a common plane, the end loops of all of said coil springs except for said corner coil springs being generally circular and the end loops of said corner coil springs being non-circular, said border wire having sides located in close adjacency to border segments of the end loops of said edge coil springs and having arcuate corners located contiguous to border segments of said non-circular end loops of said corner coils, and said lacing wire being generally helical in configuration and being tightly wrapped around said border wire and said border segments of said corner and edge coil springs to connect said border wire to said corner and edge coil springs, said spring assembly being manufactured by the method of locating said border wire in close adjacency to the outer peripheral border segments of said end loops in said corner and edge coil springs, deflecting said border segments of said corner coil springs out of an initial configuration into a different configuration in which said border segments of said corner coil springs are contiguous to and of approximately the same radius as an adjacent corner segment of said border wire, wrapping said helical lacing wire around said border wire and around said border segments of said edge coils and around said deflected segments of said corner coil springs while maintaining the border segments of said corner coil springs deflected into said different configurations, and releasing said corner coil springs end loop segments from said deflected configurations after lacing the end loops of said sides and corner coil springs to said border wire.

30. The coil spring assembly of claim 29 in which said lacing wire is of a single continuous one-piece length which extends around the complete periphery of said assembly.

31. A method of joining a generally rectangular coil spring matrix and rectangular border wire, said matrix including a plurality of rows of coil springs having end loops located in a common plane, said matrix having corner and edge coil springs located around the peripheral edge of said matrix, said method comprising the steps of locating said border wire in close adjacency to the outer peripheral segments of said end loops of said corner and edge coil springs, deflecting a border segment of at least one end loop of one of said corner coil springs out of an initial configuration into a different configuration in which said border segment of said end loop of said corner coil spring is contiguous to and of approximately the same radius as an adjacent corner segment of said border wire, wrapping a single helical lacing wire around said border wire and around said deflected segment of said end loop of said corner coil spring and around the outer peripheral segments of end loops of edge coil springs located along at least one side of said matrix which is adjacent said deflected segment of said corner coil spring while maintaining the border segment of said end loop of said corner coil spring deflected into said different configuration, and releasing said corner coil springs' end loop segment from said deflected configuration after lacing the end loops of coil springs of said side and one corner to said border wire.

32. A method of joining a generally rectangular coil spring matrix and rectangular border wire, said matrix including a plurality of rows of coil springs having end loops located in a common plane, said matrix having corner and edge coil springs located around the peripheral edge of said matrix, said method comprising the steps of locating said border wire in close adjacency to the outer peripheral segments of said end loops of said corner and edge coil springs, deflecting a border segment of at least one end loop of one of said corner coil springs out of an initial configuration into a different configuration in which said border segment of said end loop of said corner coil spring is contiguous to and of approximately the same radius as an adjacent corner segment of said border wire, deflecting a border segment of the end loops of side edge coil springs located along at least one side of said matrix which is adjacent said deflected segment of said corner coil spring into a different configuration in which said deflected border segments of said side edge coil springs are generally flat and contiguous to a segment of said border wire, wrapping a single helical lacing wire around said border wire and around said deflected segments of said side edge and corner coil spring while maintaining the border segments of said side edge and corner coil springs deflected into said different configurations, and releasing said corner and side edge coil springs' end loop segments from said deflected configurations after lacing the end loops of said side and corner to said border wire.

33. A method of joining a generally rectangular coil spring matrix and a peripheral lacing wire, said matrix including a plurality of rows of coil springs having end loops located in a common plane, said matrix having corner and edge coil springs located around the peripheral edge of said matrix, said method comprising the steps of deflecting a border segment of the end loops of each of said edge coil springs located along four sides of said matrix into a different configuration in which said deflected border segments of said side edge coil springs are generally flat;

wrapping a single helical lacing wire around said border segments of said edge coil springs on said four sides of said matrix and around border segments of said corner coils springs while maintaining the border segments of said side edge coil springs deflected into said different configurations, and releasing said side edge coil springs' border segments from said deflected configurations after wrapping of said border segments by said single helical lacing wire.

34. The method as set forth in claim 33 wherein said wrapping step comprises rotating said lacing wire and guiding said rotating lacing wire around the entire periphery of said matrix without stopping rotation of said lacing wire while continuously feeding said lacing wire into lacing relation with the border segments of said corner and edge coil springs.

35. The method as set forth in claim 34, wherein said wrapping step comprises locating said border wire and corner and side edge coil springs relative to die halves that define a helical path about the periphery of said coil spring matrix, said helical path embracing said border segments of said corner and edge coil springs.

36. The method as set forth in claim 33 wherein said deflecting step comprises providing die halves that cooperate one with another to define a helical path for said helical lacing wire, and moving said die halves into helical path defining relation one with another about said border segments of said corner and edge coil springs, said die halves simultaneously deflecting said border segments of said edge coil springs in the course of moving into said helical path defining relation.

* * * * *

UNITED STATES PATENT AND TRADEMARK OFFICE

CERTIFICATE OF CORRECTION

PATENT NO. : 4,295,639

DATED : Oct. 20, 1981

INVENTOR(S) : Thomas J. Wells

It is certified that error appears in the above—identified patent and that said Letters Patent is hereby corrected as shown below:

Abstract - line 5 - "rotation" should be -- rotating --

Column 8, line 39, "this" should be -- the --

Column 8, line 41 "3-8" should be -- 2-8 --

Column 10, line 25 after "equal" insert -- one --

Column 11, line 33, "61b" should read -- 60b --.

Column 18, line 47, delete "said"

Column 19, line 62 "continuous" should be -- contiguous --

Column 21, line 51, insert a period at the end.

Signed and Sealed this

*Twenty-seventh* Day of *April 1982*

[SEAL]

*Attest:*

GERALD J. MOSSINGHOFF

*Attesting Officer*

*Commissioner of Patents and Trademarks*